US011308977B2

(12) United States Patent
Moon et al.

(10) Patent No.: US 11,308,977 B2
(45) Date of Patent: Apr. 19, 2022

(54) PROCESSING METHOD OF AUDIO SIGNAL USING SPECTRAL ENVELOPE SIGNAL AND EXCITATION SIGNAL AND ELECTRONIC DEVICE INCLUDING A PLURALITY OF MICROPHONES SUPPORTING THE SAME

(71) Applicant: Samsung Electronics Co., Ltd., Gyeonggi-do (KR)

(72) Inventors: Hangil Moon, Gyeonggi-do (KR); Aran Cha, Gyeonggi-do (KR); Hwan Shim, Gyeonggi-do (KR); Gunwoo Lee, Gyeonggi-do (KR); Kyuhan Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 128 days.

(21) Appl. No.: 16/733,735

(22) Filed: Jan. 3, 2020

(65) Prior Publication Data

US 2020/0219525 A1 Jul. 9, 2020

(30) Foreign Application Priority Data

Jan. 4, 2019 (KR) ..... 10-2019-0001044

(51) Int. Cl.

| | |
|---|---|
| ***G10L 21/038*** | (2013.01) |
| ***H04R 1/10*** | (2006.01) |
| ***G10L 19/02*** | (2013.01) |
| ***G10L 19/08*** | (2013.01) |

(52) U.S. Cl.

CPC ..... *G10L 21/038* (2013.01); *G10L 19/0204* (2013.01); *G10L 19/08* (2013.01); *H04R 1/10* (2013.01)

(58) Field of Classification Search

CPC ..... G10L 21/038; H04R 1/10

See application file for complete search history.

(56) References Cited

U.S. PATENT DOCUMENTS

| | | | |
|---|---|---|---|
| 8,213,629 | B2 | 7/2012 | Goldstein et al. |
| 9,892,739 | B2 | 2/2018 | Liu et al. |
| 9,997,173 | B2 | 6/2018 | Dusan et al. |
| 10,217,475 | B2 | 2/2019 | Lee et al. |

(Continued)

FOREIGN PATENT DOCUMENTS

| | | | |
|---|---|---|---|
| KR | 10-1077328 | B1 | 10/2011 |
| KR | 10-2017-0001125 | A | 1/2017 |
| KR | 10-1850693 | B1 | 4/2018 |

OTHER PUBLICATIONS

International Search Report dated Jun. 25, 2020.

*Primary Examiner* — Shaun Roberts
(74) *Attorney, Agent, or Firm* — Cha & Reiter, LLC.

(57) ABSTRACT

According to an embodiment, the above-described specification discloses an electronic device comprises at least one processor configured to: receive a first audio signal and a second audio signal; detect a spectral envelope signal from the first audio signal and extract a feature point from the second audio signal; extend a high-band of the second audio signal based on the spectral envelope signal from the first audio signal and the feature point from the second audio signal to generate a high-band extension signal; and mix the high-band extension signal and the first audio signal, thereby resulting in a synthesized signal.

20 Claims, 15 Drawing Sheets

(56) References Cited

U.S. PATENT DOCUMENTS

| | | | | |
|---|---|---|---|---|
| 2008/0281604 | A1* | 11/2008 | Choo | G10L 19/0208 704/500 |
| 2009/0290721 | A1 | 11/2009 | Goldstein et al. | |
| 2010/0228543 | A1* | 9/2010 | Kabal | G10L 21/038 704/207 |
| 2011/0202353 | A1* | 8/2011 | Neuendorf | G10L 21/038 704/500 |
| 2011/0293109 | A1* | 12/2011 | Nystrom | H04R 3/005 381/94.2 |
| 2017/0263267 | A1 | 9/2017 | Dusan et al. | |
| 2018/0166085 | A1 | 6/2018 | Liu et al. | |
| 2018/0174597 | A1 | 6/2018 | Lee et al. | |
| 2018/0308505 | A1* | 10/2018 | Chebiyyam | G10L 19/0204 |

* cited by examiner

<1001>

<1003>

PROCESSING METHOD OF AUDIO SIGNAL USING SPECTRAL ENVELOPE SIGNAL AND EXCITATION SIGNAL AND ELECTRONIC DEVICE INCLUDING A PLURALITY OF MICROPHONES SUPPORTING THE SAME

CROSS-REFERENCE TO RELATED APPLICATION(S)

This application is based on and claims priority under 35 U.S.C. § 119 to Korean Patent Application No. 10-2019-0001044, filed on Jan. 4, 2019, in the Korean Intellectual Property Office, the disclosure of which is incorporated by reference herein its entirety.

BACKGROUND

1. Field

The disclosure relates to audio signal processing of an electronic device.

2. Description of Related Art

An electronic device may provide a function associated with audio signal processing. For example, the electronic device may provide a user function such as a phone call for converting sound to an audio signal, and transmitting the audio signal, and a recording function for converting sound to an audio signal and recording the audio signal. When the environment around the electronic device is noisy during a phone call, the audio signal will represent, both the user's voice, and noise. Furthermore, when a lot of ambient noise is present while the electronic device is recording, the noise and voice are recorded together. During playback, it is difficult to distinguish the voice from the noise.

The above information is presented as background information only to assist with an understanding of the disclosure. No determination has been made, and no assertion is made, as to whether any of the above might be applicable as prior art with regard to the disclosure.

SUMMARY

In accordance with an aspect of the disclosure, an electronic device comprises at least one processor configured to: receive a first audio signal and a second audio signal; detect a spectral envelope signal from the first audio signal and extract a feature point from the second audio signal; extend a high-band of the second audio signal based on the spectral envelope signal from the first audio signal and the feature point from the second audio signal to generate a high-band extension signal; and mix the high-band extension signal and the first audio signal, thereby resulting in a synthesized signal.

In accordance with another aspect of the disclosure, an audio signal processing method of an electronic device comprises: receiving a first audio signal from a first microphone among a plurality of microphones and obtaining a second audio signal through a second microphone among the plurality of microphones; detecting a spectral envelope signal from the first audio signal and extracting a feature point from the second audio signal; extending a high-band signal of the second audio signal based on the spectral envelope signal and the feature point to generate a high-band extension signal; and mixing the high-band extension signal and the first audio signal.

In accordance with another aspect of the disclosure an electronic device comprises a first microphone, a communication circuit and a processor operatively connected to the first microphone and the communication circuit, wherein the processor is configured to: obtain a first audio signal through the first microphone; identify a noise level of the first audio signal obtained by the first microphone; when the noise level exceeds a specified value, activating a second microphone configured to generate a second audio signal through the communication circuit; when obtaining the second audio signal, extract a feature point from the second audio signal; extend a high-band portion of the second audio signal based on the feature point and a spectral envelope signal extracted from the first audio signal; and mixing the high-band extension signal and the first audio signal.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

As described above, it is difficult to distinguish the clear voice due to the ambient noise when the voice is converted to an audio signal, and thus many function, including phone calls and playback of recordings may not operate with good quality.

Aspects of the disclosure may to address at least some of the above-mentioned problems and/or disadvantages and to provide at least some of the advantages described below. Accordingly, an aspect of the disclosure may provide a method of processing an audio signal that is capable of obtaining a good audio signal by using a plurality of microphones and an electronic device supporting the same.

Hereinafter, certain embodiments of the disclosure will be described with reference to accompanying drawings. However, those of ordinary skill in the art will recognize that modification, equivalent, and/or alternative on certain embodiments described herein can be variously made without departing from the scope and spirit of the disclosure.

Figure 1:
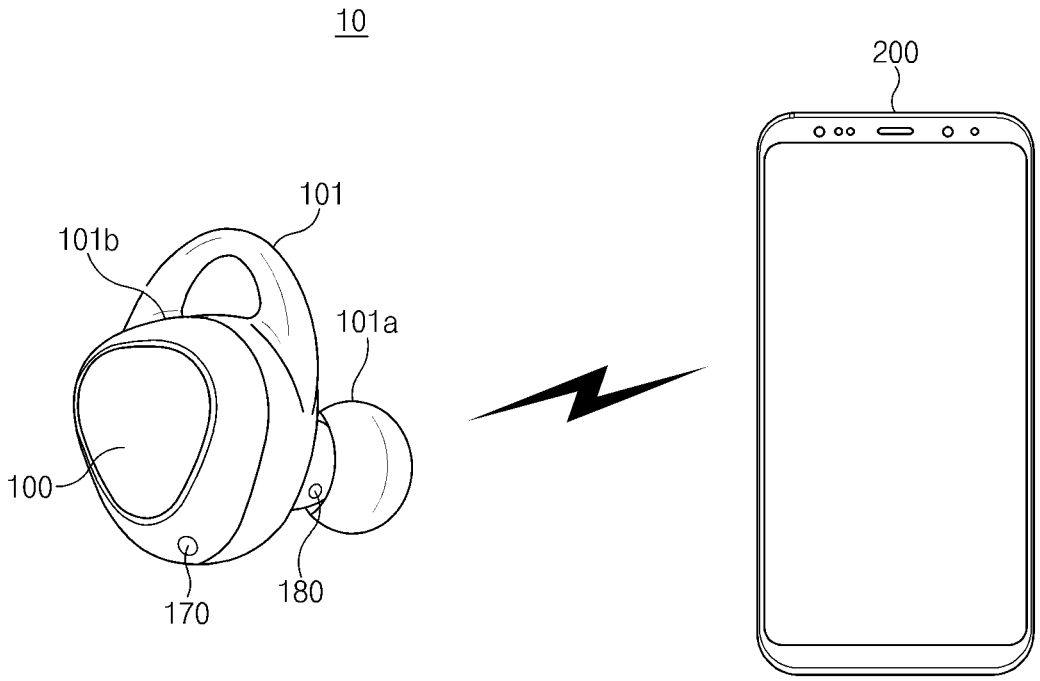
FIG. 1 is a view illustrating an example of a configuration of an audio signal processing system, according to certain embodiments.

FIG. 1 is a view illustrating an example of a configuration of an audio signal processing system, according to certain embodiments.

Referring to FIG. 1, an audio signal processing system 10 according to an embodiment may include a first electronic device 100 and a second electronic device 200. In certain embodiments, the first electronic device 100 can include an earbud mounted with microphones 180 and 170. The second electronic device 200 can include a smartphone. The earbud 100 can communicate with the smartphone 200 using short range communications, such as BlueTooth. In other embodiments, the microphones 180 and 170 can be mounted on the smartphone.

The audio signal processing system 10 having such configuration may extract a feature point in the low-band (e.g., 1 to 3 kHz, a band below 2 kHz, or a relatively narrow-band) of an audio signal collected by a specific microphone among the audio signals collected by a plurality of microphones 170 and 180. The audio signal processing system 10 may then generate a high-band extended signal (e.g., a signal to which a signal above 2 kHz is added) based on the extracted feature point and at least part of the audio signal obtained from another microphone. The feature point includes at least one of a pattern of the audio signal, a unique points of spectrum of the audio signal, MFCC(Mel Frequency Cepstral Coefficient), spectral centroid, zero-crossing, spectral flux, or energy of the audio signal.

For example, the audio signal processing system 10 may generate the high-band extended signal, using a spectral envelope signal corresponding to the audio signal obtained from the another microphone and the extracted feature point.

The audio signal processing system 10 may generate a synthesis signal by synthesizing the high-band extended signal and the audio signal obtained from the specific microphone and the other microphone among the plurality of microphones 170 and 180. The above-described audio signal processing system 10 may synthesize (or compose, or mix) audio signals after generating the high-band extended signal using the spectral envelope signal corresponding to the audio signal obtained from the other microphone and the feature point extracted in the low-band, and thus may provide a high-quality audio signal. Herein, the high-quality audio signal may include an audio signal having a relatively low noise signal or an audio signal emphasizing at least part of a relatively specific frequency band (e.g., a voice signal band).

In the above-described audio signal processing system 10, when the plurality of microphones 170 and 180 are mounted in the first electronic device 100, a method and function for processing an audio signal may be independently applied to the first electronic device 100, according to an embodiment. According to an embodiment, when a plurality of microphones are mounted in the second electronic device 200, the method and function for processing an audio signal may be independently applied to the second electronic device 200. According to certain embodiments, the method and function for processing an audio signal may group at least one microphone of the plurality of microphones 170 and 180 mounted in the first electronic device 100 and at least one of a plurality of microphones mounted in the second electronic device 200 and may generate and output the synthesis signal based on the grouped microphones.

The first electronic device 100 may be connected to the second electronic device 200 by wire or wirelessly so as to output an audio signal transmitted by the second electronic device 200. Alternatively, the first electronic device 100 may collect (or receive) an audio signal (or a voice signal), using at least one microphone and then may deliver the collected audio signal to the second electronic device 200. For example, the first electronic device 100 may include a wireless earphone capable of establishing a short range communication channel (e.g., a Bluetooth module-based communication channel) with the second electronic device 200. Alternatively, the first electronic device 100 may include a wired earphone connected to the second electronic device 200 in a wired manner. Alternatively, the first electronic device 100 may include various audio devices capable of collecting an audio signal based on at least one microphone and transmitting the collected audio signal to the second electronic device 200.

According to an embodiment, the first electronic device 100 of the earphone type may include an insertion part 101*a* capable of being inserted into the ear of a user and housing 101 (or a case) connected to the insertion part 101*a* and having a mounting part 101*b*, of which at least part is capable of being mounted in the user's auricle.

The first electronic device 100 may include the plurality of microphones 170 and 180. The first microphone 170 may be positioned such that at least part of a sound hole is exposed to the outside of the ear. Accordingly, the first microphone 170 may be mounted in the mounting part 101*b* such that the first electronic device 100 may receive an external sound (when the first electronic device 100 is worn on the user's ear).

The second microphone 180 may be positioned in the insertion part 101*a*. The second microphone 180 may be arranged such that at least part of a sound hole is exposed toward the inside of the external acoustic meatus or is contacted with at least part of the inner wall of the external acoustic meatus with respect to the opening toward the auricle of the external acoustic meatus (commonly referred to as the auditory canal). Accordingly, the second microphone 180 may receive sound from the inside of the auditory canal, when the first electronic device 100 is worn in the user's ear.

For example, when the user wears the first electronic device 100 and utters speech, at least part of the sound from the speech vibrates through the user's skin, muscles, bones, or the like into the auditory canal. The vibrations, or sound, may be received by the second microphone 180 inside an ear. According to certain embodiments, the second microphone 180 may include various types of microphones (e.g., in-ear microphones, inner microphones, or bone conduction microphones) capable of collecting sound in the cavity of the user's inner ear.

According to certain embodiments, the first microphone 170 may include a microphone designed to convert sound in a frequency band (at least part of the range of 1 Hz to 20 kHz) wider than the second microphone 180 to an electronic signal. According to an embodiment, the first microphone 170 may include a microphone designed to convert sound in the entire frequency band of the human voice. According to an embodiment, the first microphone 170 may include a microphone designed to collect the signal in a frequency band, which is higher than the second microphone 180, at a specified quality value or more.

According to an embodiment, the second microphone 180 may be a microphone that is different in characteristic from the first microphone 170. For example, the second microphone 180 may include a microphone designed to convert sound in a frequency band (a narrow-band, for example, at least part of the range of 0.1 kHz to 3 kHz) narrower than the first microphone 170 to an electric signal. According to an embodiment, the second microphone 180 may include a sensor (e.g., an in-ear microphone or a bone conduction microphone) capable of creating an analog signal that is a relatively good (or of a specified quality value or more) representation of the speech with Signal to Noise Ratio (SNR) less than a specified amount. The specified amount for the second microphone can be less than the SNR typically received by the first microphone 170. According to an embodiment, the second microphone 180 may include a microphone designed convert sound in a frequency band to an audio signal, the frequency band being lower than the first microphone 170, at the specified quality.

Accordingly, in certain embodiments, the audio signal generated by the second microphone can be considered the "gold standard" or a signal known to exclude noise beyond a certain amount.

The first electronic device 100 may extract a feature point from the second audio signal. The first electronic device 100 may then generate a high-band extended signal by extending the frequency band of the second audio signal based on the spectral envelope of the first audio signal and the extracted feature point. The first electronic device 100 may synthesize (or compose or mix) the high-band extended signal and the first audio signal and may output the synthesized signal (or the composed signal, or the mixed signal). For example, the first electronic device 100 may output the synthesized signal through a speaker, may store the synthesized signal in a memory, or may transmit the synthesis signal to the second electronic device 200.

The first electronic device 100 and the second electronic device 200 can operate together during a phone call/video call. The first electronic device 100 can generally perform the sound/audio signal conversion, while the second electronic device 200 performs interfaces with a communication network to establish communications with an external communication device.

The first electronic device 100 can convert voice to an audio signal and provide over a communication channel (such as BlueTooth) the audio signal to the second electronic device. The second electronic device 200 can transmit the audio signal to an external electronic device using a communication network, such as the Internet, a cellular network, the public switched telephone network or a combination thereof. The second electronic device can also receive an audio signal and provide the audio signal to the first electronic device 100 over the communication channel. The second electronic device can convert the audio signal received from the second electronic device to sound simulating another party's voice using a speaker.

During a video call, the second electronic device 200 can capture video of the user and display video from the another party at the external electronic device. The video signals can also be transmitted over the communication network.

Additionally, various audio signal processing tasks can be distributed between the first electronic device 100 and the second electronic device 200.

The second electronic device 200 may establish a communication channel with the first electronic device 100, may deliver a specified audio signal to the first electronic device 100, or may receive an audio signal from the first electronic device 100. For example, the second electronic device 200 may become a variety of electronic devices, such as a mobile terminal, a terminal device, a smartphone, a tablet PC, pads, a wearable electronic device, which are capable of establishing a communication channel (e.g., a wired or wireless communication channel) with the first electronic device 100. When the second electronic device 200 receives a synthesized signal from the first electronic device 100, the second electronic device 200 may transmit the received synthesized signal to an external electronic device over a network (e.g., a call function), may store the received synthesized signal in a memory (e.g., a recording function), or may output the received synthesized signal to a speaker of the second electronic device 200. According to an embodiment, the second electronic device 200 may synthesize and output audio signals in the process of outputting audio signals stored in the memory (e.g., playback function). Alternatively, when the second electronic device 200 includes a camera, the second electronic device 200 may perform a video shooting function in response to a user input. In this operation, the second electronic device 200 may collect audio signals when shooting a video and may perform a signal synthesis (or signal processing) operation.

According to certain embodiments, the second electronic device 200 may establish a communication channel with the first electronic device 100, may receive audio signals collected by the plurality of microphones 170 and 180 from the first electronic device 100, and may perform signal synthesis based on the audio signals. For example, the second electronic device 200 may extract a feature point from the second audio signal provided by the first electronic device 100, may extend at least part of a frequency band of the second audio signal based on the extracted feature point and the spectral envelope signal extracted from the first audio signal, may synthesize (or compose, or mix) the band-extended audio signal (e.g., a signal, of which a high-band is extended using a low-band signal feature point and the spectral envelope signal obtained from another microphone) and the first audio signal to generate a synthesized signal, and may output the synthesized signal (e.g., may output the synthesized signal through the speaker of the second electronic device 200, may transmit the synthesized signal to an external electronic device, or may store the synthesized signal in the memory of the second electronic device 200).

According to certain embodiments, the second electronic device 200 may select an audio signal having a relatively good (or the noise is less than the reference value or the sharpness of the voice feature is not less than the reference value) low-band signal and may generate the synthesized signal by extracting a feature point from the low-band signal. In this process, the second electronic device 200 may perform frequency analysis on the first audio signal and the second audio signal and may use the audio signal, in which the distribution of the low-band signal is shown clearly or frequently, to extract the feature point and to extend a high-band signal. Alternatively, the second electronic device 200 may extract a feature point from the audio signal (e.g., the second audio signal generated by the second microphone 180 of the first electronic device 100) specified by the first electronic device 100 and may perform high-band signal extension (the extension of the high-band signal using the spectral envelope signal extracted from the first audio signal and the feature point) and signal synthesis.

According to certain embodiments, the second electronic device 200 may generate a synthesized signal based on the first audio signal generated by at least one microphone mounted in the first electronic device 100 and the second audio signal generated by the microphone of the second electronic device 200. In this operation, the second electronic device 200 may extract the feature point from the audio signal provided by the first electronic device 100 or may extract the feature point from the audio signal generated from the microphone of the second electronic device 200. Alternatively, the second electronic device 200 may receive microphone information (for example, specification from the manufacturer) from the first electronic device 100, may compare the received microphone information with the microphone information of the second electronic device 200, and may use the audio signal generated by the microphone having good characteristics with respect to a relatively low-band signal to extract the feature point. In this regard, the second electronic device 200 may store the microphone information capable of grasping the characteristics of the frequency band in advance and may determine where the microphone with a good collection capability is installed (e.g., in the first electronic device 100 or the second electronic device 200) with respect to a relatively low-band signal, using pieces of microphone information. The second electronic device 200 may extract the feature point of the low-band signal from the audio signal generated by the identified microphone and perform high-band signal extension and signal synthesis.

In the meantime, an embodiment is exemplified in the above-described details as the audio signal processing system 10 includes the first electronic device 100 and the second electronic device 200. However, the disclosure is not limited thereto. As described above, because an audio signal processing function according to an embodiment of the disclosure supports the extraction of the feature point of a low-band signal using a plurality of microphones (or a plurality of microphones with different characteristics), the extension of a high-band signal using at least part of characteristics of the audio signal obtained by other microphones, the synthesis function with the audio signal obtained by the other microphone, the signal synthesis function of the audio signal processing system 10 may be performed by the first electronic device 100, may be performed by the second electronic device 200, or may be performed through the collaboration of the first electronic device 100 and the second electronic device 200.

As described above, the audio signal processing system 10 according to an embodiment may generate audio signals by using microphones having a plurality of different characteristics depending on an environment for collecting the audio signal, may extract a feature point from a single audio signal of the generated audio signals, may detect a spectral envelope signal from another audio signal, and may provide a good quality audio signal through the synthesis with another audio signal after performing band extension.

According to certain embodiments, the audio signal processing system 10 may selectively operate whether a signal synthesis function is applied. For example, when the noise included in the audio signal generated by a specific microphone (e.g., the microphone having a good collection capability with respect to a relatively wide-band (or high-band) signal) among the plurality of microphones 170 and 180 is not less than a specified value, the audio signal processing system 10 may perform the signal synthesis function. According to an embodiment, when the noise included in the audio signal generated by the specific microphone among the plurality of microphones 170 and 180 is less than the specified value, the audio signal processing system 10 may omit the signal synthesis function. In this regard, after collecting the audio signal using the first microphone 170, when the noise level is not less than the specified value, the first electronic device 100 may activate the second microphone 180; when the noise level is less than the specified value, the first electronic device 100 may maintain the second microphone 180 in an inactive state. According to an embodiment, when the noise included in the audio signal generated by a specific microphone (e.g., the microphone having a good collection capability with respect to a relatively wide-band signal) among the plurality of microphones 170 and 180 is not less than a specified value, the audio signal processing system 10 may perform noise processing (e.g., noise suppressing) on the audio signal and then may perform the signal synthesis function.

Figure 2:
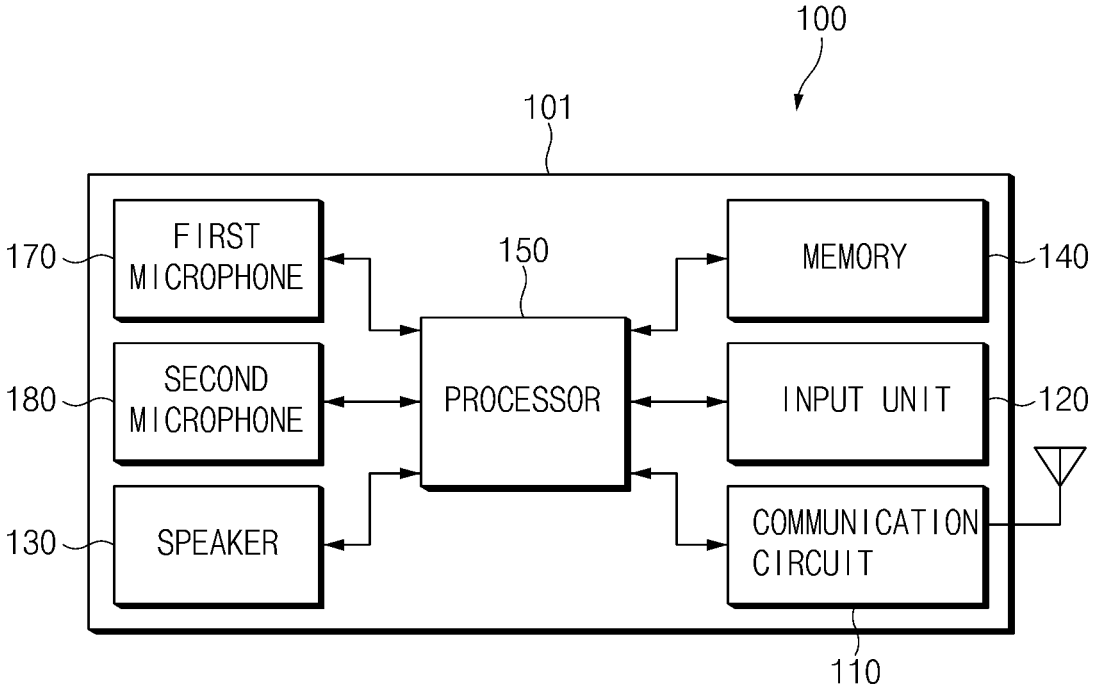
FIG. 2 is a view illustrating an example of configuration included in a first electronic device, according to certain embodiments.

FIG. 2 is a view illustrating an example of configurations included in a first electronic device, according to certain embodiments.

Referring to FIGS. 1 and 2, the first electronic device 100 may include at least one of a communication circuit 110, an input unit 120, a speaker 130, a memory 140, the first microphone 170 and the second microphone 180, or a processor 150. Additionally or alternatively, the first electronic device 100 may include the housing 101 surrounding at least one of the communication circuit 110, the input unit 120, the speaker 130, the memory 140, the first microphone 170 and the second microphone 180, or the processor 150. According to an embodiment, the first electronic device 100 may further include a display. The display may indicate operating states of the plurality of microphones 170 and 180, the operating state of a signal synthesis function, a battery level, and the like. In an embodiment, an embodiment is exemplified as the first electronic device 100 includes the first microphone 170 and the second microphone 180. However, the disclosure is not limited thereto. For example, the first electronic device 100 may include three or more microphones.

The communication circuit 110 may support the communication function of the first electronic device 100. For example, the communication circuit 110 may include at least one of an Internet network communication circuit for accessing an Internet network, a broadcast reception circuit capable of receiving broadcasts, and a mobile communication circuit associated with mobile communication function support, and/or a short range communication circuit capable of establishing a communication channel with the second electronic device 200. For example, the communication circuit 110 may include a circuit capable of directly performing communication without a repeater such as Bluetooth, Wi-Fi Direct, or the like. According to an embodiment, the communication circuit 110 may include a Wi-Fi communication module (or circuit) capable of accessing an Internet network and/or a Wi-Fi direct communication module (or a Bluetooth communication module) capable of transmitting and receiving input information. Alternatively, the communication circuit 110 may establish a communication channel with a base station supporting a mobile communication system and may transmit and receive an audio signal to and from an external electronic device through the base station.

According to an embodiment, the input unit 120 may include a device capable of receiving a user input with regard to the function operation of the first electronic device 100. The input unit 120 may receive a user input associated with the operations of the plurality of microphones 170 and 180. For example, the input unit 120 may receive a user input associated with at least one of a configuration of turning on or off the first electronic device 100, a configuration of operating only the first microphone 170, a configuration of operating only the second microphone 180, and a configuration of turning on or off a function to synthesize and provide an audio signal based on the first microphone 170 and the second microphone 180. For example, the input unit 120 may be provided as at least one physical button, a touch pad, or the like.

The speaker 130 may be disposed on one side of the housing 101 of the first electronic device 100 so as to output the audio signal received from the second electronic device 200, the audio signal received through the communication circuit 110, or the signal generated by at least one microphone activated among the plurality of microphones 170 and 180. In this regard, the speaker 130 may be positioned such that at least part of a sound hole from which the audio signal is output is exposed through the insertion part 101*a*.

The first microphone 170 and the second microphone 180 may be positioned on one side of the housing 101 and may be provided such that audio signal collection characteristics are different from one another. The first microphone 170 and the second microphone 180 may be the first microphone 170 and the second microphone 180, which are described in FIG. 1, respectively.

The memory 140 may store an operating system associated with the operation of the first electronic device 100, and/or a program supporting at least one user function executed through the first electronic device 100 or at least one application. According to an embodiment, the memory 140 may include a program supporting an audio signal synthesis function, a program provided to transmit audio signals generated by at least one microphone (e.g., at least one of the first microphone 170 and the second microphone 180) to the second electronic device 200, and the like. According to an embodiment, the memory 140 includes an application supporting a recording function and may store the audio signal generated by at least one microphone. According to an embodiment, the memory 140 may include an application supporting a playback function that outputs the stored audio signal and may store a plurality of audio signals generated by the plurality of microphones 170 and 180 with different characteristics. According to an embodiment, the memory 140 may include an application supporting the video shooting function and may store an audio signal generated by a plurality of microphones or a synthesized signal generated based on the audio signal generated by a plurality of microphones during video recording.

With regard to the operation of the first electronic device 100, the processor 150 may perform execution control of at least one application and may perform data processing such as the transfer, storage, and deletion of data according to the execution of the at least one application. According to an embodiment, when the execution of a function associated with the collection of audio signals, for example, the execution of at least one of a call function (e.g., at least one of a voice call function or a video call function), a recording function, or a video shooting function, is requested, the processor 150 may identify an ambient noise environment. For example, when the execution of a call function, a recording function, or a video shooting function is requested, the processor 150 may identify the value obtained by comparing the ambient noise signal with the audio signal. When the level of the noise signal is greater than the level of the audio signal by the specified value or more (e.g., when the level difference between the noise signal and the audio signal is not less than 0 dB or when the level of the noise signal is greater than the level of the audio signal by 0 dB or more), the processor 150 may activate the plurality of microphones 170 and 180 with respect to the signal synthesis function.

According to an embodiment, when the execution of a call function, a recording function, or a video shooting function is requested, the processor 150 may identify the values of the ambient noise signal and the audio signal. When the value obtained by comparing the noise signal with the audio signal is less than the specified value (e.g. when there is no noise signal or when the level of the audio signal is not less than the noise signal size by the specified value or more), the processor 150 may activate and operate at least part of the plurality of microphones 170 and 180 without applying the signal synthesis function. For example, when the level of the noise signal is less than the level of the audio signal by the specified value (e.g. when there is no noise signal or when the level of the noise signal is less than the specified value or less), the processor 150 may activate only the first microphone 170, which is positioned in the mounting part 101*b* among the plurality of microphones 170 and 180 and is capable of collecting an external audio signal.

According to certain embodiments, with regard to the operation of the first electronic device 100, when the execution of a playback function is requested, the processor 150 may determine whether to synthesize the signal depending on the characteristics of the audio signals to be played. For example, when the audio signals stored in the memory 140 are the first audio signal and the second audio signals described above with reference to FIG. 1, the extension of a high-band signal is performed using the spectral envelope signal detected from the first audio signal and the feature point extracted from the second audio signal and the playback function that synthesizes and outputs the high-band extended signal and the first audio signal may be supported.

The processor 150 may perform the extraction of a feature point, the extension of a high-band signal, and the synthesis of the high-band extended audio signal and the audio signal generated from another microphone on the audio signals generated by the plurality of microphones 170 and 180. The processor 150 may transmit the synthesized signal to the second electronic device 200 or an external electronic device or may store the synthesized signal in the memory 140.

According to certain embodiments, with regard to the signal synthesis function, the processor 150 may extract a feature point from an audio signal (or the audio signal (e.g., an audio signal (a narrow-band signal) generated by a microphone (e.g., narrow-band microphone) designed to generate a signal in a relatively low (or narrow) frequency band (or low-band) or the second audio signal described in FIG. 1), in which a signal in a relatively low frequency band is occupied by a specified value or more among the entire obtained frequency bands, from among the audio signals generated by the plurality of microphones 170 and 180. The processor 150 may extend the low-band signal to the high-band, using the extracted feature point and the spectral envelope signal detected from the audio signal (e.g., a signal in a relatively wide frequency band). The processor 150 may synthesize (or compose or mix) the extended audio signal and the audio signal (or an audio signal (e.g., a wide-band signal, 1 Hz to 20 kHz) generated by a microphone (e.g., a wide-band microphone) designed to generate a signal in a relatively high frequency band or designed to generate a signal throughout the voice frequency band or the first audio signal described in FIG. 1), which has a wider frequency band distribution than the audio signal used for the signal extension, and may output the synthesized signal. For example, the processor 150 may transmit the synthesized signal to the second electronic device 200 or store the synthesized signal in a memory.

According to certain embodiments, the processor 150 may analyze the signal state of the audio signals generated by the plurality of microphones 170 and 180 to determine whether signal synthesis is required, based on at least one of the first audio signal or the second audio signal. For example, the processor 150 may calculate the cut-off frequency (Fc) of the first audio signal and may determine whether there is a need for the extension (e.g., extend a signal in a relatively high frequency region) of the high-band of a signal and signal synthesis, depending on the magnitude of Fc. According to an embodiment, when the magnitude of the Fc is not less than the specified value, the processor 150 may omit signal high-band extension and signal synthesis; when the magnitude of the Fc is less than the specified value, the processor 150 may perform signal high-band extension and signal synthesis.

According to certain embodiments, the processor 150 may determine whether to apply the noise pre-processing depending on the level of the noise included in the first audio signal. For example, when the level of the noise included in the obtained audio signal is not less than the specified value, the processor 150 may perform the noise pre-processing and then may synthesize (or compose or mix) the pre-processed first audio signal and the high-band extended signal. According to an embodiment, when the level of the noise included in the first audio signal is less than the specified value, the processor 150 may synthesize the obtained first audio signal and the high-band extended signal without performing the noise pre-processing.

Figure 3:
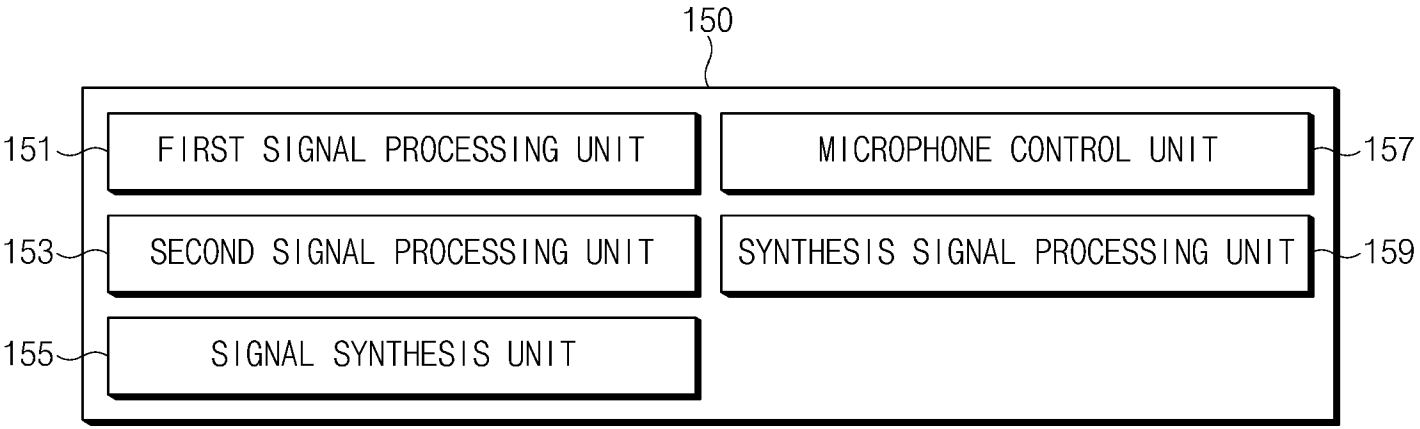
FIG. 3 is a view illustrating an example of a configuration of a processor of a first electronic device according to certain embodiments.

FIG. 3 is a view illustrating an example of a configuration of a processor of a first electronic device according to certain embodiments.

Referring to FIG. 3, the processor 150 may include a first signal processing unit 151, a second signal processing unit 153, a signal synthesis unit 155, a microphone control unit 157, and a synthesized signal processing unit 159. At least one of the first signal processing unit 151, the second signal processing unit 153, the signal synthesis unit 155, the microphone control unit 157, and the synthesized signal processing unit 159 described above may be provided as a sub-processor, an independent processor, or in the form of software, and thus may be used during the signal synthesis function of the processor 150.

The first signal processing unit 151 may determine whether to synthesize a signal. For example, when the execution of a call function, a recording function, or a video shooting function is requested, the first signal processing unit 151 may generate an audio signal using at least one microphone of the plurality of microphones 170 and 180, may identify the noise level included in the audio signal, and may apply a signal synthesis function depending on the identified result. Alternatively, the first electronic device 100 may be configured to perform the signal synthesis function by default, without identifying whether there is a need to execute the signal synthesis function according to the determination of the noise level. In this case, the first signal processing unit 151 may omit the determination of whether there is a need to execute the signal synthesis function.

The first signal processing unit 151 may control the processing of the audio signal generated by the first microphone 170. For example, when a call function, a recording function, or a video shooting function is executed, the first signal processing unit 151 may activate the first microphone 170 and may detect a spectral envelope signal based on the first audio signal collected by the first microphone 170. According to an embodiment, the first signal processing unit 151 may identify the level of the noise included in the obtained audio signal and may apply pre-processing to the first audio signal depending on the level of the noise. For example, when the ambient noise level is not less than a specific value, the first signal processing unit 151 may perform noise suppression on the first audio signal and may detect a spectral envelope signal (wide-band spectral envelope) for the first audio signal based on a specified signal analysis scheme (e.g., Linear Prediction Analysis). In a process of detecting a spectral envelope signal, the first signal processing unit 151 may use a pre-stored first speech source filter model. The first signal processing unit 151 may deliver the spectral envelope signal detected from the first audio signal to the second signal processing unit 153 and may transmit the pre-processed first audio signal to the signal synthesis unit 155. The first speech source filter model may include a reference model generated through the audio signals obtained through the first microphone 170 in a good environment (e.g., an environment in which there is no noise or an environment in which a noise level is not greater than a specified value).

The second signal processing unit 153 may extract feature points from the second audio signal generated by the second microphone 180. In this regard, when the signal synthesis function is requested, the second signal processing unit 153 may activate the second microphone 180. The second signal processing unit 153 may performs pre-processing (e.g., echo canceling and/or noise suppression) on the second audio signal generated by the activated second microphone 180 and may extract feature points by performing analysis on the signal-processed audio signal. Herein, the echo canceling during the pre-processing may be omitted depending on the spaced distance between the speaker 130 and the second microphone 180. The second signal processing unit 153 may perform the extension of a high-band signal based on the extracted feature points and the spectral envelope signal of the first audio signal delivered from the first signal processing unit 151. According to an embodiment, the second signal processing unit 153 may obtain a narrow-band excitation signal based on the extracted feature points and a second speech source filter model pre-stored in the memory 140. The second speech source filter model may include information obtained by modeling a voice signal obtained through the second microphone 180 in an environment in which there is no noise or an environment in which a noise level is not greater than a specified value. The second signal processing unit 153 may deliver a high-band extended signal (or relatively high area in the second audio signal) to the signal synthesis unit 155 based on the narrow-band excitation signal and the spectral envelope signal.

The signal synthesis unit 155 may receive the pre-processed first audio signal output from the first signal processing unit 151 and a high-band extended signal (or high-band extended excitation signal) output from the second signal processing unit 153. The signal synthesis unit 155 may generate a synthesized signal using a specified synthesis scheme (e.g., linear prediction synthesis) with respect to the received first audio signal and the high-band extended signal.

When the execution of a call function or voice function is requested, the microphone control unit 157 may allow at least one microphone among the plurality of microphones 170 and 180 to be activated depending on a condition. For example, when the signal synthesis function is set by default, the microphone control unit 157 may request the first signal processing unit 151 and the second signal processing unit 153 to activate the first microphone 170 and the second microphone 180 depending on the request for the audio signal collection (e.g., depending on a request for the execution of a call function, a recording function, or a video shooting function). When the call function, the recording function, or the video shooting function is terminated, the microphone control unit 157 may allow the activated first microphone 170 and the activated second microphone 180 to be deactivated.

The synthesized signal processing unit 159 may perform the processing of the synthesized signal. For example, when the call function is operated, the synthesized signal processing unit 159 may transmit a synthesized signal to the second electronic device 200 through the communication circuit 110 or may transmit the synthesized signal to an external electronic device. According to an embodiment, the synthesized signal processing unit 159 may store the synthesized signal in the memory 140 when the recording function is operated.

Figure 4:
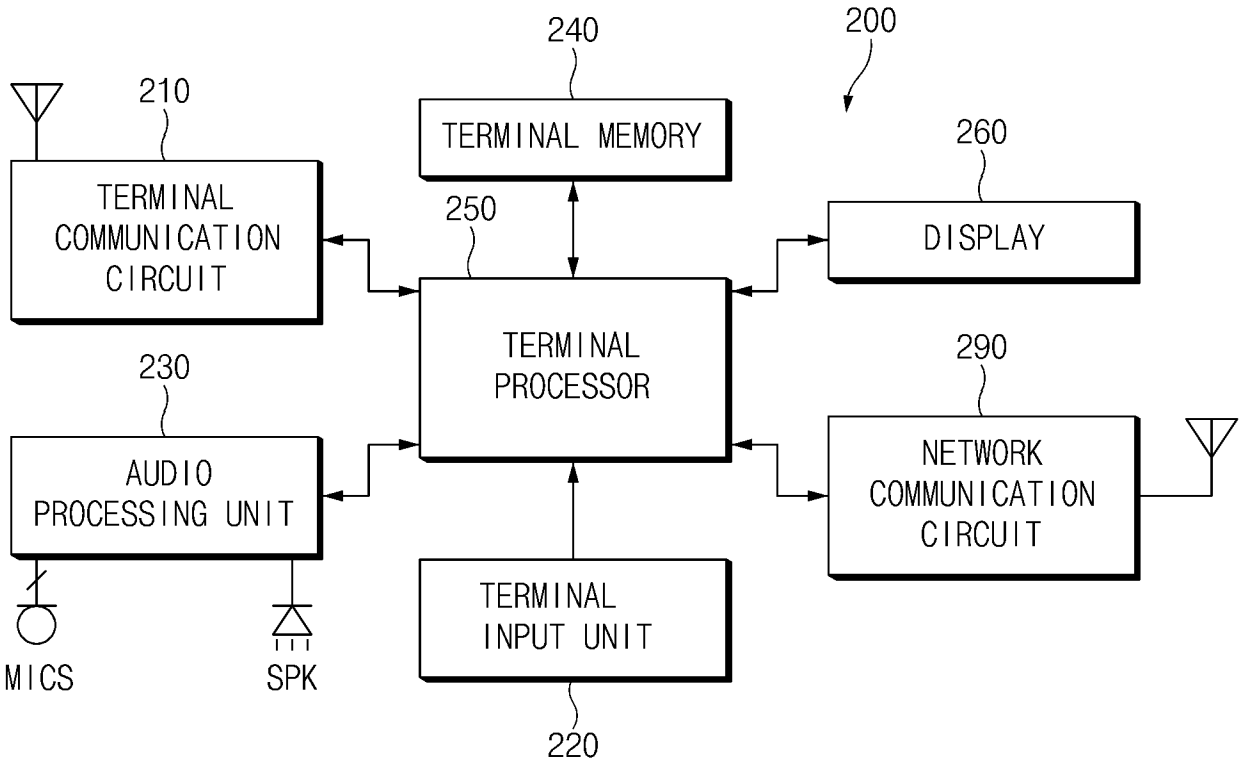
FIG. 4 is a view illustrating an example of a configuration of a second electronic device according to certain embodiments.

FIG. 4 is a view illustrating an example of a configuration of a second electronic device according to certain embodiments.

Referring to FIG. 4, the second electronic device 200 according to an embodiment may include a terminal communication circuit 210, a terminal input unit 220, an audio processing unit 230, a terminal memory 240, a display 260, a network communication circuit 290, and a terminal processor 250.

The terminal communication circuit 210 may support an operation associated with a communication function of the second electronic device 200. For example, the terminal communication circuit 210 may establish a communication channel with the communication circuit 110 of the first electronic device 100. The terminal communication circuit 210 may include a circuit compatible with the communication circuit 110. For example, the terminal communication circuit 210 may include a short range communication circuit capable of establishing a short range communication channel. According to an embodiment, the terminal communication circuit 210 may perform a pairing process to establish a communication channel with the communication circuit 110 and may receive a synthesized signal from the first electronic device 100. According to certain embodiments, the terminal communication circuit 210 may receive the audio signal generated by at least one microphone of the microphones 170 and 180 included in the first electronic device 100.

The terminal input unit 220 may support a user input of the second electronic device 200. For example, the terminal input unit 220 may include at least one of a physical button, a touch pad, an electronic pen input device, or a touch screen. When the second electronic device 200 includes a connection interface and an external input device (e.g., a mouse, a keyboard, or the like) is connected via the connection interface, the connection interface may be included as the partial configuration of the terminal input unit 220. The terminal input unit 220 may generate at least one user input associated with a signal synthesis function in response to a user manipulation and may deliver the generated user input to the terminal processor 250.

The audio processing unit 230 may support the audio signal processing function of the second electronic device 200. The audio processing unit 230 may include at least one speaker SPK and at least one or more microphones MICs. For example, the audio processing unit 230 may include one speaker SPK and a plurality of microphones MICs. The audio processing unit 230 may support a signal synthesis function under the control of the terminal processor 250. For example, when the audio processing unit 230 receives a first audio signal from the first electronic device 100 and receives a second audio signal from at least one microphone of the microphones MICs, the audio processing unit 230 may perform pre-processing on at least one signal of the received first audio signal and the received second audio signal. The audio processing unit 230 may generate a synthesized signal depending on the signal synthesis scheme described above with reference to FIGS. 1 to 3 based on pre-processed audio signals. Under the control of the terminal processor 250, the audio processing unit 230 may store the synthesized signal in the terminal memory 240 or may transmit the synthesized signal to an external electronic device through the network communication circuit 290. The audio processing unit 230 may include a codec with regard to the above-described signal synthesis function support.

The terminal memory 240 may store at least part of data, at least one program, or an application associated with the operation of the second electronic device 200. For example, the terminal memory 240 may store a call function application, a recording function application, a sound source playback function application, a video shooting function application, and the like. The terminal memory 240 may store a synthesized signal received from the first electronic device 100. According to certain embodiments, the terminal memory 240 may store the synthesized signal generated by the audio processing unit 230. According to an embodiment, the terminal memory 240 may store a first audio signal received from the first electronic device 100 and a second audio signal. According to an embodiment, the terminal memory 240 may store the first audio signal (or the second audio signal) received from the first electronic device 100 and the second audio signal (or the first audio signal) generated by at least one microphone among a plurality of microphones MICs of the second electronic device 200.

The display 260 may output at least one screen associated with the operation of the second electronic device 200. For example, the display 260 may output a screen according to a call function operation, a recording function operation, or a video shooting function operation of the second electronic device 200. According to an embodiment, when the call function, the recording function, or the video shooting function is operated, the display 260 may output a virtual object corresponding to a communication connection state with the first electronic device 100, a signal synthesis function configuration state based on the first electronic device 100, a signal synthesis function configuration state of the second electronic device 200, and the like. According to an embodiment, the display 260 may output a screen according to the operation of the sound source playback function. Herein, the display 260 may output a virtual object corresponding to at least one of a state of performing signal synthesis based on a plurality of audio signals stored in the terminal memory 240 and an output state of the synthesized signal.

The network communication circuit 290 may establish a remote communication channel of the second electronic device 200 or may establish a base station-based communication channel of the second electronic device 200. For example, the network communication circuit 290 may include a mobile communication circuit. The network communication circuit 290 may transmit the synthesized signal transmitted by the first electronic device 100 through the communication circuit 110 or the synthesized signal generated by the second electronic device 200, to an external electronic device.

The terminal processor 250 may control data processing, the transfer of data, the activation of a program, and the like, which are required to operate the second electronic device 200. According to an embodiment, the terminal processor 250 may output a virtual object associated with the execution of a call function (e.g., a voice call function or a video call function) to the display 260 and may execute the call function in response to the selection of the virtual object. According to an embodiment, the terminal processor 250 may establish a communication channel with the first electronic device 100 (or may maintain the communication channel when the communication channel is already established) and may transmit or receive an audio signal associated with the call function to or from the first electronic device 100. For example, the terminal processor 250 may receive a synthesized signal from the first electronic device 100 to transmit the synthesized signal to the external electronic device through the network communication circuit 290. According to certain embodiments, when performing a call function, the terminal processor 250 may generate an audio signal, using the retained plurality of microphones MICs without receiving the audio signal from the first electronic device 100 and may synthesize and output signals based on the generated audio signals.

According to an embodiment, while performing a call function, the terminal processor 250 may receive the first audio signal (or the second audio signal) from the first electronic device 100, may deliver the first audio signal to the audio processing unit 230, may synthesize the first audio signal and the second audio signal (or the first audio signal) generated by at least one microphone among the microphones MICs included in the second electronic device 200, and then may allow the synthesized result to be transmitted to the external electronic device. For example, the first audio signal may include an audio signal having the high distribution of a signal having a wider frequency band than the second audio signal. Alternatively, the second audio signal may include an audio signal having the high distribution of a signal having a narrower frequency band than the first audio signal.

When performing a recording function, the terminal processor 250 may establish a communication channel with the first electronic device 100 (or may maintain the communication channel when the communication channel is already established) and may store the synthesized signal transmitted by the first electronic device 100 in the terminal memory 240. According to an embodiment, the terminal processor 250 may synthesize the audio signal transmitted by the first electronic device 100 and the audio signal generated by at least one microphone among the microphones MICs and may store the synthesized signal in the terminal memory 240. According to certain embodiments, when performing a recording function, the terminal processor 250 may perform audio signal collection, high-band signal extension, or signal synthesis and output, based on the retained plurality of microphones MICs without the communication connection with the first electronic device 100 or the reception of an audio signal from the first electronic device 100.

When performing a video shooting function, the terminal processor 250 may establish a communication channel with the first electronic device 100 (or may maintain the communication channel when the communication channel is already established) and may store the synthesized signal transmitted by the first electronic device 100 in the terminal memory 240, while storing the images captured using a camera. According to an embodiment, the terminal processor 250 may synthesize the audio signal transmitted by the first electronic device 100 and the audio signal generated by the microphones MICs and may store the synthesized signal in the terminal memory 240. According to an embodiment, when performing the video shooting function, while storing the image captured using a camera, the terminal processor 250 may synthesize the generated audio signal based on the plurality of microphones MICs and may store the synthesized signal in the terminal memory 240.

Figure 5:
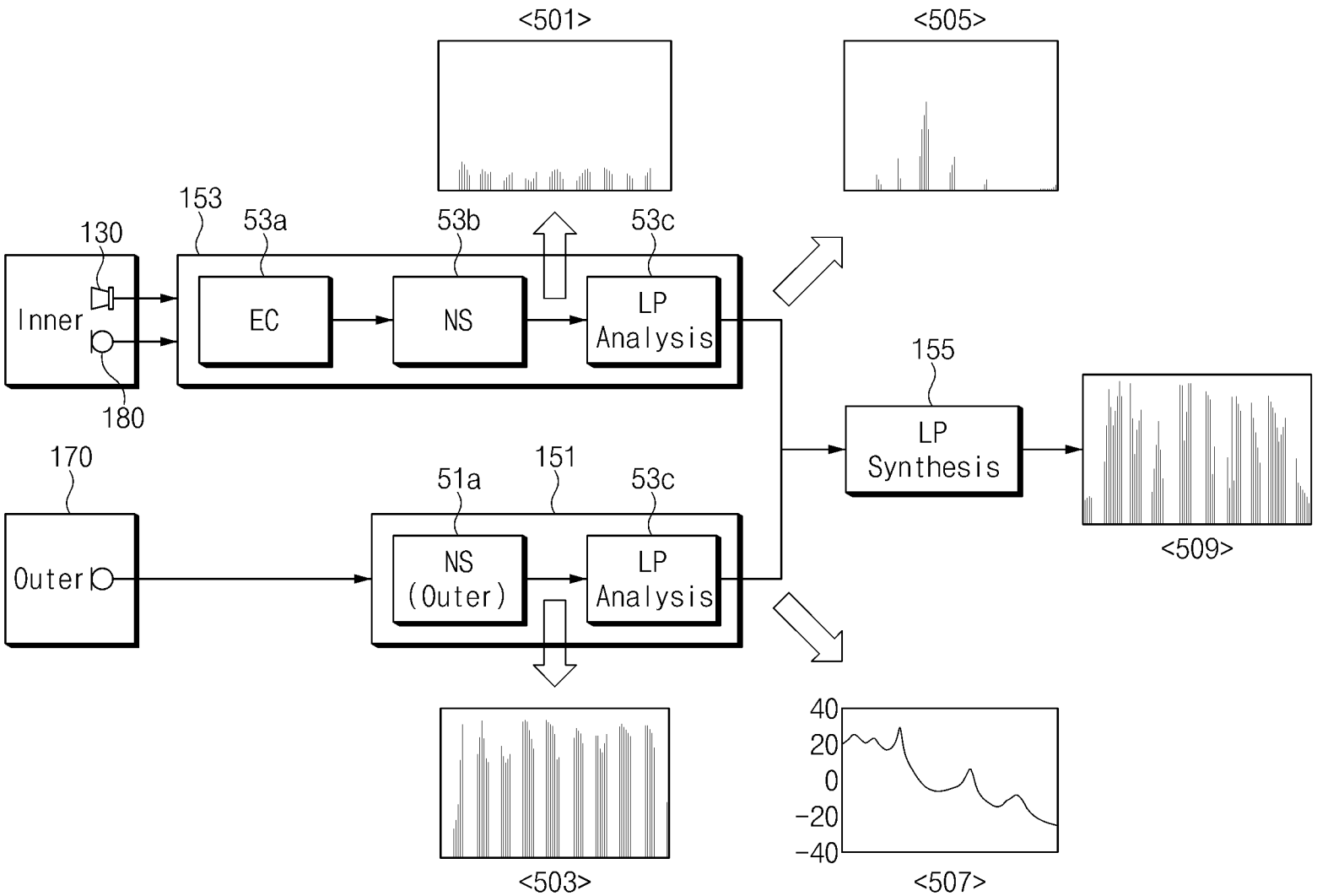
FIG. 5 is a view illustrating an example of a partial configuration of a first electronic device according to certain embodiments.

FIG. 5 is a view illustrating an example of a partial configuration of a first electronic device according to certain embodiments.

Referring to FIG. 5, at least part of the first electronic device 100 according to an embodiment may include the first microphone 170, the second microphone 180, the speaker 130, the first signal processing unit 151, the second signal processing unit 153, and the signal synthesis unit 155.

For example, the first microphone 170 and the second microphone 180 may be the first microphone 170 and the second microphone 180, which are described in FIG. 1 or 2, respectively. The speaker 130 may be the speaker 130 described with reference to FIG. 2. In the illustrated drawing, a structure in which the speaker 130 is disposed adjacent to the second microphone 180 is illustrated. However, the disclosure is not limited thereto.

The first signal processing unit 151 may include a first noise processing unit 51*a* and a first signal analysis unit 51*c*, which are connected to the first microphone 170. For example, the first noise processing unit 51*a* may perform noise-suppression. According to an embodiment, the first noise processing unit 51*a* may selectively perform noise processing on the first audio signal generated by the first microphone 170 under the control of the processor 150. For example, when the level of noise included in the first audio signal is not less than a specified value, the first noise processing unit 51*a* may perform noise processing on the first audio signal. In the noise processing, the first noise processing unit 151 may determine noise level using a certain method such as determination of spectrum of an audio signal. When the level of noise included in the first audio signal is less than the specified value, the first noise processing unit 51*a* may skip the noise processing on the first audio signal. According to an embodiment, the preprocessed audio signal output by the first noise processing unit 51*a* may exhibit a waveform shape as illustrated in graph 503. In the graph, the horizontal axis may represent time, and the vertical axis may represent a frequency value. For example, the frequency value can be the instantaneous center frequency of the audio signal.

The first signal analysis unit 51*c* may perform signal analysis (e.g., linear prediction analysis) on the noise-processed audio signal in advance by the first noise processing unit 51*a*. The first signal analysis unit 51*c* may perform signal analysis on the audio signal and may output a spectral envelope signal based on the signal analysis result. For example, the spectral envelope signal output from the first signal analysis unit 51*c* may represent a waveform form as illustrated in graph 507. In graph 507, the horizontal axis is frequency and the vertical axis is the linear prediction coefficients in decibels (dB).

The second signal processing unit 153 may include an echo processing unit 53*a*, a second noise processing unit 53*b*, and a second signal analysis unit 53*c*, which are connected to the second microphone 180.

The echo processing unit 53*a* may process the echo of the signal obtained through the second microphone 180. For example, the audio signal output by the speaker 130 may be delivered to the input of the second microphone 180. The echo processing unit 53*a* may remove at least part of the signal, which is output through the speaker 130 and then is entered into the second microphone 180. The echo processing unit 53*a* may perform residual echo cancellation (RES). According to certain embodiments, when the distance between the second microphone 180 and the speaker 130 is spaced by the specified distance or more, the configuration of the echo processing unit 53*a* may be omitted from the second signal processing unit 153.

Similarly to the first noise processing unit 51*a*, the second noise processing unit 53*b* may perform the pre-processing (e.g., noise-suppression) of the echo-canceled second audio signal. According to an embodiment, the audio signal pre-processed by the second noise processing unit 53*b* may exhibit a waveform shape as illustrated in state 501. The second microphone 180 may include a microphone provided to generate a low-band signal with a quality better than the first microphone 170 or to generate a specified low-band signal. As such, as illustrated, in the second audio signal obtained by the second microphone 180, a distribution within low-band signals may be relatively large. The second noise processing unit 53*b* may obtain the signal, which is advantageous to a noise environment and is processed by Echo Cancellation & Noise-suppression (ECNS), from the second microphone 180 (e.g., an inner microphone).

According to an embodiment, the second audio signal obtained through the second microphone 180 may be transmitted through the human body, not being delivered through an external path (e.g., an air path). The second audio signal generated by the second microphone 180 may include a low-band signal (about 2 kHz) due to the nature of the transmission through the human body. In the case of the signal transmitted through the human body, because the noise is physically blocked even in a very high noise environment (Signal to Noise Ratio (SNR) of −10 dB or less), the second audio signal generated by the second microphone 180 may have a high SNR. When the noise processing (e.g., noise suppression) is performed on the signal having high SNR, a clear audio signal may be generated. Furthermore, when the signal is extended to a high-band, because the possibility of obtaining a good signal may be increased using the signal in which the noise is removed maximally, the second signal processing unit 153 may remove the noise using the echo processing unit 53*a* and the second noise processing unit 53*b*. According to certain embodiments, the configuration of the second noise processing unit 53*b* may be omitted or the execution of the function may be omitted depending on the noise environment.

The second signal analysis unit 53*c* may perform signal analysis on the audio signal noise-processed in advance by the second noise processing unit 53*b*. The second signal analysis unit 53*c* may perform signal analysis on the audio signal, which is generated by the second microphone 180 and is noise-processed in advance, and may output a high-band extended signal (or a high-band extended excitation signal) based on the signal analysis result and the spectral envelope signal output from the first signal analysis unit 51*c*. For example, the high-band extended signal output from the second signal analysis unit 53*c* may represent a waveform form as illustrated in state 505.

The first signal analysis unit 51*c* and the second signal analysis unit 51*c* may separate the excitation signal and the spectral envelope signal, using a source filter model, respectively. Assume that the voice signal of the current time has the high correlation with the samples of the past voice signal, the linear prediction analysis may be expressed as Equation 1 below, as an analysis method predicted by 'N' past linear combinations.

$$\tilde{A}(z)=\Sigma_i^N \tilde{a}_i z^{-1} \text{ and } \tilde{u}_{nb}(k)=\Sigma_i^N \tilde{a}_i s_{nb}(k-l) \quad \text{[Equation 1]}$$

$\tilde{A}(z)$ may denote the estimated spectral envelope signal (vocal tract transfer function); $\tilde{a}_i$ may denote LP coefficients constituting the estimated spectral envelope; $\tilde{u}_{nb}$ may denote the estimated narrow-band excitation signal; $s_{nb}$ may denote a voice signal (e.g., narrow-band signal); k may denote a sample index. The first signal analysis unit 51*c* may extract an excitation signal corresponding to a sound source from the audio signal and the second signal analysis unit 53*c* may extract a spectral envelope signal corresponding to the vocal tract transfer function, based on the above-described linear prediction analysis.

According to an embodiment, the processor 150 of the first electronic device 100 may perform analysis (decomposition) based on the source filter model method and may extract signals having high-quality characteristics in each frequency band, for example, the spectral envelope signal corresponding to the first audio signal and an excitation signal (or narrow-band excitation signal) for the second audio signal.

According to certain embodiments, the second signal analysis unit 53*c* may estimate the high-band excitation signal by extending the narrow-band excitation signal obtained through the source filter model method to the wide-band by using the spectral envelope signal. In this regard, the second signal analysis unit 53*c* may copy the signal (e.g., an excitation signal) estimated by linear prediction analysis and may consecutively paste the copied signal to a higher band (high-band) using frequency modulation. The high-band signal extension of the second signal analysis unit 53*c* may be performed based on Equation 2 below.

$$\tilde{u}_{hb}(k)=\tilde{u}_{nb}(k)2\cos(w_m k) \quad \text{[Equation 2]}$$

In Equation 2, $\tilde{u}_{hb}$ may denote a signal (or a high-band extended signal, an excitation signal, or a high band) when the modulated upper band is excited; $w_m$ may denote a modulation frequency to which the excitation signal is copied and then pasted. In the extension of a low-band signal (a range of 0.1 kHz to 3 kHz, for example, 2 kHz to 3 kHz), the second signal analysis unit 53*c* may determine the modulation frequency, using $F_0$ information (fundamental frequency) of the audio signal obtained from the second microphone 180 to minimize a metallic sound (or a mechanical sound). The fundamental frequency $F_0$ may be obtained through Equation 3 below.

$$w_m = \left\lceil \frac{w_0}{F_0} \right\rceil F_s \quad \text{[Equation 3]}$$

In Equation 3, $F_S$ may denote a sampling frequency; $W_0$ may denote $2\pi F_C/F_S$; $F_C$ may denote a cutoff frequency (e.g., 2 kHz); $F_0$ may denote a fundamental frequency. In certain embodiments, the fundamental frequency $F_0$ can be the feature point. Because the periodic characteristic of the excitation signal differ with time, the modulation frequency may be determined by calculating the frequency value to be pasted for natural expansion depending on the specified condition (e.g., extending the periodic characteristic of the excitation signal to the high-band based on the spectral envelope signal). The second signal analysis unit 53*c* may restore unvoiced speech, which is likely to be lost in the second audio signal having a low-band signal, through the expansion of the excitation signal of the noise component.

The signal synthesis unit 155 (LP Synthesis) may perform the combination (e.g., linear prediction synthesis) of the high-band extended excitation signal output through the first signal processing unit 151 and the audio signal (or a spectral envelope signal) noise-processed through the second signal processing unit 153. For example, the signal synthesis unit 155 may synthesize signals having the advantages of signals decomposed through both the first signal processing unit 151 and the second signal processing unit 153. For example, the signal synthesized by the signal synthesis unit 155 may indicate a spectrum as illustrated in state 509 (additionally, see the FIG. 11).

Figure 6:
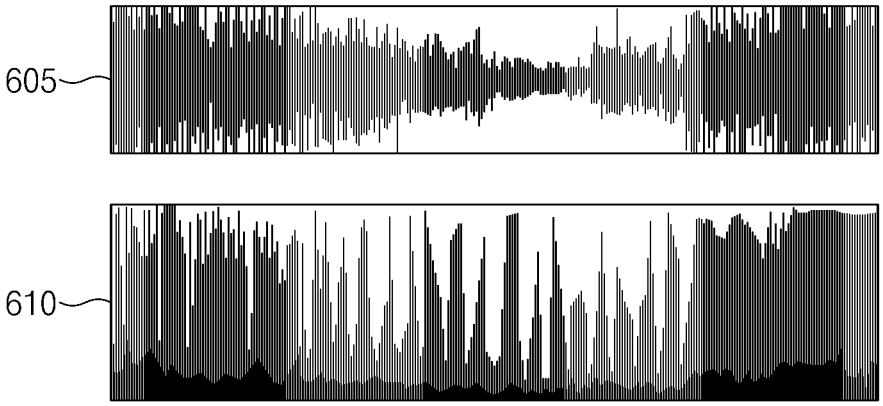
FIG. 6 is a view illustrating a waveform and a spectrum of an audio signal obtained by a first microphone in an external noise situation, according to an embodiment.

FIG. 6 is a view illustrating a waveform 605 and a spectrum 610 of an audio signal obtained by a first microphone in an external noise situation, according to an embodiment. Alternatively, the illustrated drawing shows the waveform and spectrum of the audio signal obtained using the first microphone 170 (e.g., an external microphone) positioned at a location affected by wind in a windy condition of a specific speed or more.

In FIG. 6, the x-axis of the graph indicates time; the y-axis of the upper graph 605 shows amplitude of the generated signal; the y-axis of the lower graph shows the frequency (such as center frequency) of the generated signal. The audio signal generated by the first microphone 170 may include the speaker's voice and the noise of external wind. The illustrated drawing may mean a state in which the intensity of wind is changed in order of strong→weak→strong. When the wind is strong, it is impossible to distinguish the speaker's voice.

Figure 7:
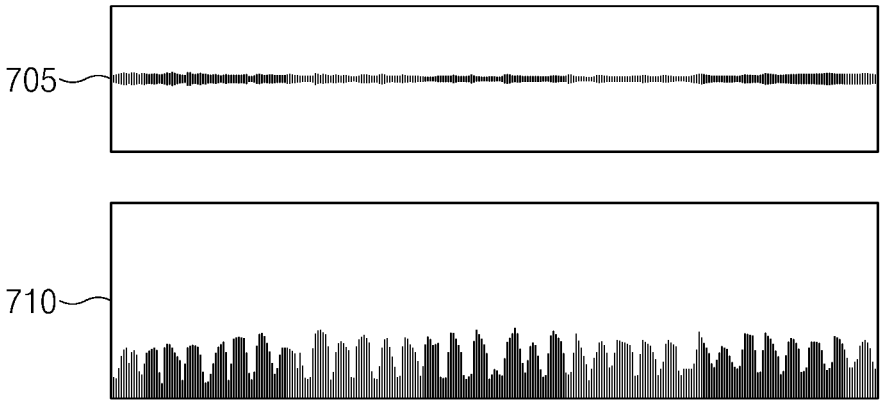
FIG. 7 is a view illustrating a waveform and a spectrum of an audio signal obtained by a second microphone in an external noise situation, according to an embodiment.

FIG. 7 is a view illustrating a waveform 705 and a spectrum 710 of an audio signal obtained by a second microphone in an external noise situation, according to an embodiment. For example, the illustrated drawing shows the waveform and spectrum of the audio signal obtained using the second microphone 180 (e.g., an in-ear microphone) in the same situation as the situation of the external noise described above with reference to FIG. 6. When the graph shown in FIG. 7 is compared with the graph shown in FIG. 6, because the voice spectrum is clearly shown in the speaker's voice and the external wind noise generated by the second microphone 180 clearly shows the voice spectrum as compared to the speaker's voice and the external wind noise generated by the first microphone 170, it is possible to distinguish the voice during listening. It may be understood that there is no information of the voice signal of about 2 kHz or more in the speaker's voice and the external wind noise generated by the second microphone 180. The first electronic device 100 according to an embodiment may improve the quality of voice through band extension to a relatively high frequency band (e.g., 2 kHz or more).

Figure 8:
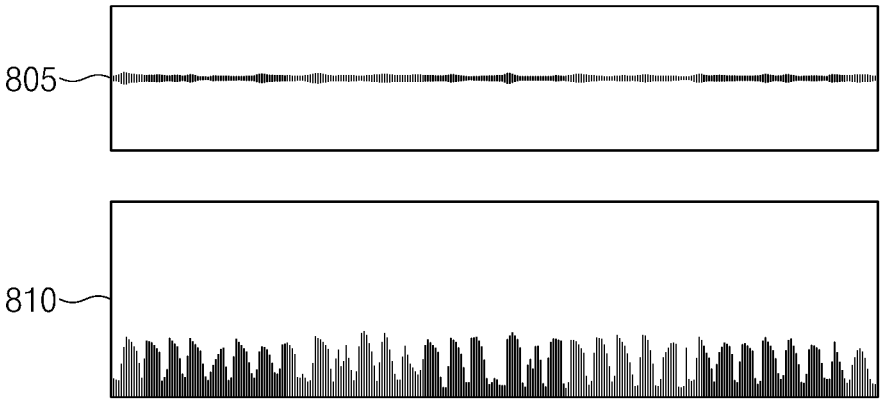
FIG. 8 is a view illustrating a waveform and a spectrum of a signal after pre-processing is applied to the audio signal illustrated in FIG. 7.

FIG. 8 is a view illustrating a waveform 805 and a spectrum 810 of a signal after pre-processing (e.g., eco-cancelation (EC) or noise-suppression (NS)) is applied to the audio signal illustrated in FIG. 7 from the second microphone.

As illustrated in FIG. 8, when the pre-processing (e.g., EC or NS) is performed on the signal generated by the second microphone 180, the pre-processed signal may indicate a state where there is relatively little noise, as compared to the signal illustrated in FIG. 7.

Figure 9:
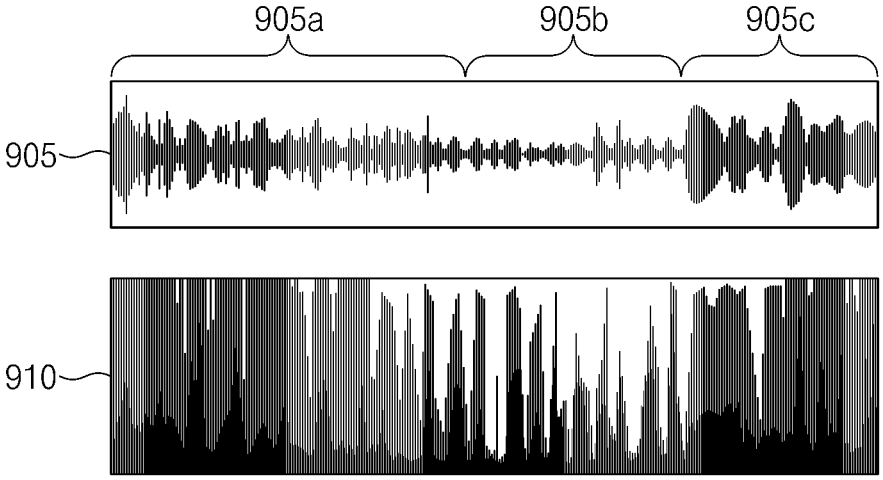
FIG. 9 is a diagram illustrating a waveform and a spectrum obtained by applying preprocessing (e.g., NS) to the audio signal illustrated in FIG. 6.

FIG. 9 is a diagram illustrating a waveform 905 and a spectrum 910 obtained by applying preprocessing (e.g., NS) to the audio signal of the first microphone 170 illustrated in FIG. 6.

Referring to FIG. 9, it is understood that NS processing is performed well on a signal (e.g., the middle of the graph 905*b*) of low wind; it is understood that the voice and noise are distributed in specific portions in a signal (e.g., left/right portions of the graph 905*a*, 905*c*) of strong wind. In the case of comparing the graph illustrated in FIG. 6, because a relatively low noise signal may be obtained, as illustrated in FIG. 9, the first electronic device 100 or the second electronic device 200 may obtain a signal obtained by performing noise preprocessing on the signal obtained by the second microphone 180 with regard to the spectral envelope signal acquisition.

In the meantime, in the case of a general band extending a band using a single microphone signal, because the method extends the band between 7 kHz and 8 kHz from a voice signal in the band of 3.5 kHz to 4 kHz, there is a lot of noise information as compared to the case of extending the voice signal in about 2 kHz band described in the above-described embodiment. Accordingly, it is difficult to obtain the result of high sound quality. The first electronic device 100 according to an embodiment may perform band extension that obtains the advantages of each microphone input, using audio signals generated by the first microphone 170 and the second microphone 180 having different characteristics. For example, the first microphone 170 may obtain information in which voice and noise are mixed in a noisy situation but may obtain information of the speaker voice in all frequency bands. In this operation, it is possible to perform preprocessing (e.g., NS) on the audio signal generated by the first microphone 170 for the purpose of minimizing noise when band extension is applied.

Figure 10:
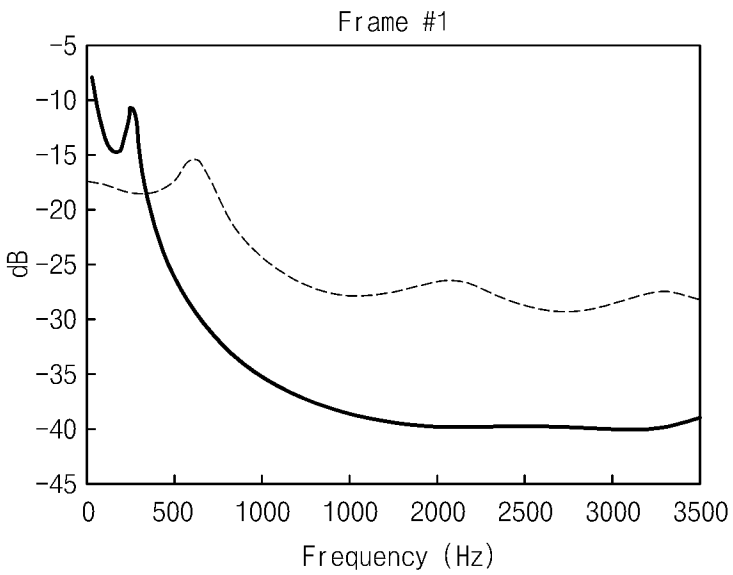
FIG. 10 is a view illustrating an example of a spectral envelope signal for a first audio signal and a second audio signal according to an embodiment.
Figure 10:
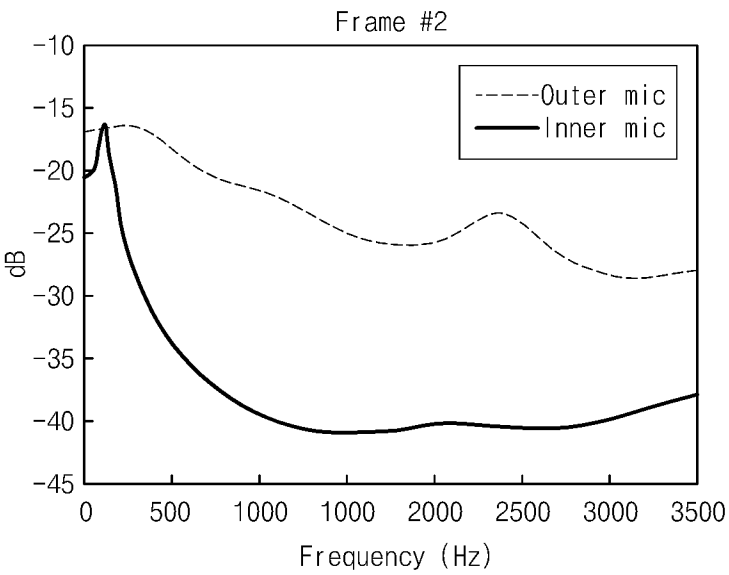

FIG. 10 is a view illustrating an example of a spectral envelope signal for a first audio signal and a second audio signal according to an embodiment.

The illustrated drawing is illustrated by extracting a first frame (graph 1001) and a second frame (graph 1003) among frames including an audio signal. For example, the first frame (graph 1001) and second frame (graph 1003) may be frames obtained at different time points while an audio signal is generated. The dotted graph illustrates the frequency curve and magnitude of the audio signal obtained by the outer microphone (or the first microphone 170); the solid graph illustrates the frequency curve and magnitude of the audio signal obtained by the in-ear microphone (or inner microphone or the second microphone 180).

Because there is a difference in the characteristic between the audio signal generated by a microphone by sound in an air environment (e.g., Air), as is generated by the first microphone 170 and the signal generated by sound conducted through the structure of a human body, according to an embodiment, the second microphone 180, the audio processing system may restore the voice similar to an actual signal through by using spectral envelope information of the first microphone 170.

In the drawing, the y-axis may indicate the size (dB scale) of the spectral envelope. Because the speaker's high-band characteristic is not known in the spectral envelope signal estimated based on the signal obtained from the narrow-band microphone (or the second microphone 180), the audio signal processing system according to an embodiment may use a spectral envelope signal estimated from a wide-band microphone (or the first microphone 170 or an external microphone) having wide band information. The audio signal processing system according to an embodiment may generate a high-band extended signal using a narrow-band excitation signal (in certain embodiments, the narrow-band excitation signal can be the extracted feature point) and a wide-band spectral envelope signal; as signal synthesis is performed based on the high-band extended signal, the audio signal processing system according to an embodiment may synthesize and output a good sound-quality audio signal even though the vocal tract transfer function is continuously changed depending on the characteristics of the speaker and the uttered word. Such the audio signal processing system is advantageous for band extension because the audio signal processing system extends the narrow-band signal to a high-band; as the synthesis of audio signals is performed based on the signal, on which band extension is performed, using a wide-band (or relatively wide band) spectral envelope signal including the characteristics of the speaker's voice, it may maintain the characteristics of the speaker's voice and may remove the problem that the synthesized signal does not sound like a human voice or sounds like a robot to provide a natural audio signal like the speaker's original voice.

Figure 11:
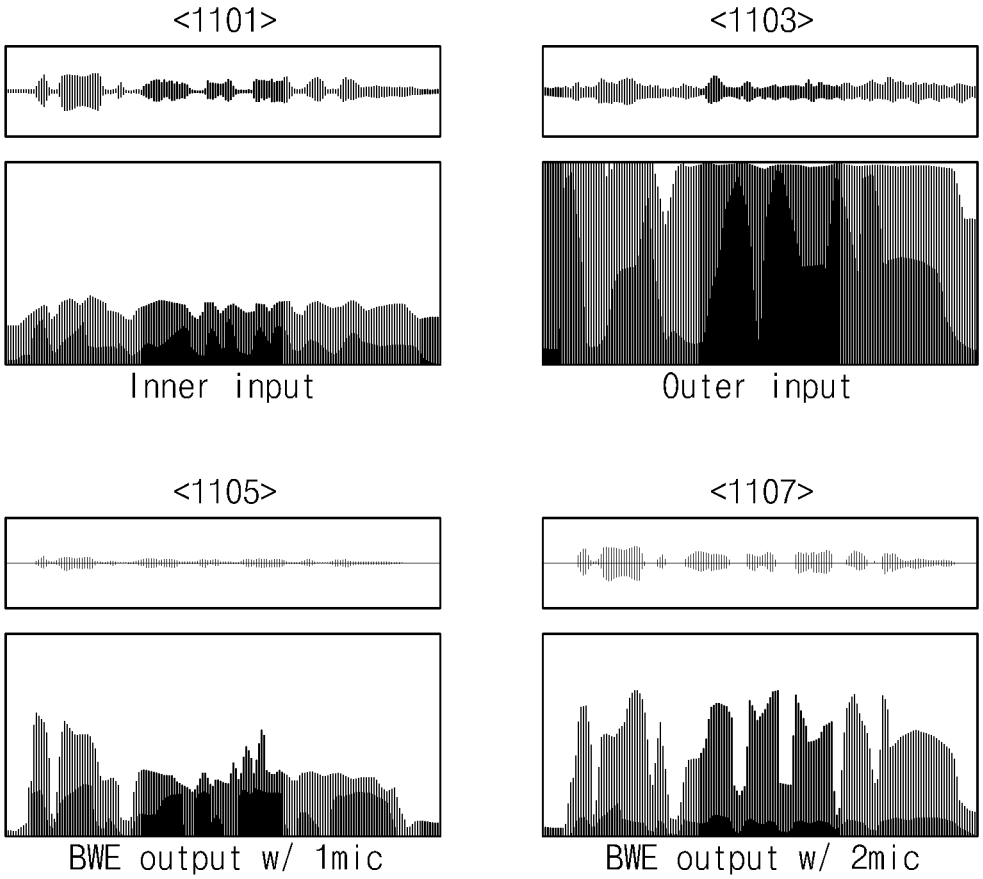
FIG. 11 illustrates a waveform and a spectrum associated with signal synthesis according to an embodiment.

FIG. 11 illustrates a waveform and a spectrum associated with signal synthesis according to an embodiment.

Referring to FIG. 11, graph 1101 may represent a signal waveform obtained from the second microphone 180 (e.g., an in-ear microphone input). Graph 1103 may represent a signal waveform obtained from the first microphone 170 (e.g., an external microphone input). Graph 1105 may represent a waveform corresponding to a signal obtained by extending the input signal of the second microphone 180 illustrated in graph 1101 to a high-band. Graph 1107 may represent a waveform of an audio signal obtained by combining a high-band extended signal and the signal obtained from the first microphone 170.

As illustrated in FIG. 11, the audio processing system according to an embodiment may extend the high-band signal of the input signal of the second microphone 180, which is relatively noiseless as compared to the first microphone 170, and may synthesize the input signal of the first microphone 170, which is capable of collecting a relatively wide-band (or wider-band) signal as compared to the second microphone 180, with the high-band extended signal; accordingly, the audio processing system according to an embodiment may support the generation and output of a natural audio signal with low noise, which is similar to the user's voice.

When executing a call function, a recording function, or a video shooting function, the above-described audio signal processing system according to certain embodiments may output a good audio signal by performing band extension of a voice signal and signal synthesis, using an in-ear microphone collecting an audio signal in an external acoustic meatus and a separate microphone (e.g., a microphone positioned in a terminal device or other wearable devices). When executing a call function, a recording function, or a video shooting function, the audio signal processing system according to an embodiment may generate signals, using a bone conduction microphone and a separate microphone and may output good audio signals based on the synthesis of the generated signals. The audio signal processing system according to an embodiment may improve recognition rate, using a plurality of microphones (at least two of 170, 180, MICs) with different characteristics in noise environment with low SNR, when executing a voice recognition function.

When the phone call is conducted, in a situation where the microphone disposed on the bottom surface of the terminal device (e.g., the second electronic device 200) including a plurality of microphones is blocked, the audio signal processing system according to an embodiment may support the output of the audio signal of a good characteristic based on the synthesis of the audio signals obtained by the lower microphone and the upper microphone. In this regard, the terminal device may analyze the signal obtained by the microphone disposed on the bottom surface of a case (or housing); when the distribution of the low-band signals included in the signal obtained from the lower microphone is not less than a specified value (or when the distribution of high-band signals of a specified magnitude or more in the signal distributions of the entire frequency band is less than the specified value), the terminal device may activate the upper microphone. The terminal device may obtain a high-band extended signal based on the audio signal obtained from the lower microphone and then may synthesize (or compose or mix) the high-band extended signal and the signal obtained from the activated upper microphone to output the synthesized signal.

In the case where a multichannel recording function is executed based on a plurality of microphones MICs positioned in a terminal device (e.g., the second electronic device 200), when a single microphone is blocked or poor in performance, the audio processing system according to an exemplary embodiment may perform multi-channel audio band extension, using information of another channel input. In this regard, when the distribution of low-band signals included in the audio signal of a specific channel is not less than the specified value, the terminal device may determine that the microphone of the corresponding channel is blocked or degraded.

According to an embodiment, when water enters the specific microphone, the terminal device may perform high-band extension of the signal obtained from the corresponding microphone and may perform synthesis with the signal obtained from another microphone. With regard to the determination of water inflow, the microphone of the terminal device includes at least one terminal for determining water inflow and may determine water inflow, when the terminals are shorted by the incoming water. Alternatively, the terminal device may include at least one sensor for determining water inflow and may determine whether water is entered, by determining the signal generated by the sensor.

According to certain embodiments, when a receiver speaker (or a speaker) positioned in a headset device or a terminal device is designed to support a microphone function, the audio processing system according to an embodiment may perform high-band signal extension with respect to the audio signal obtained using the microphone function of the receiver speaker and may perform the synthesis with the audio signal obtained from another microphone. With regard to the support of a microphone function, the receiver speaker may include a structure (as a microphone structure, for example, the signal wire electrically connected to the signal output terminal of a speaker) capable of collecting audio signals at the output terminal of the signal and may support the collection of external audio signals based on the power provided in connection with the activation of the receiver speaker.

According to certain embodiments described above, an electronic device (e.g., the first electronic device 100 of FIG. 1 or 2) according to an embodiment may include a first microphone and a second microphone (e.g., the first microphone 170 and the second microphone 180 of FIG. 1 or 2) that have different characteristics, and a processor (e.g., the processor 150 of FIG. 2) operatively connected to the first microphone and the second microphone. The processor may be configured to receive a specified function execution request, to generate a first audio signal through the first microphone in response to the function execution request, to identify a noise level of the first audio signal obtained by the first microphone, to generate a second audio signal through the second microphone when the noise level is not less than a specified value, to extract a feature point from the second audio signal, to extend a high-band of the second audio signal based on a spectral envelope signal extracted from the first audio signal and the feature point, and to perform signal synthesis based on the high-band extended signal and the first audio signal.

According to certain embodiments, the processor may be configured to omit an operation of signal synthesis and to support execution of the specified function based on the first audio signal, when the noise level is less than a specified magnitude.

According to certain embodiments, the specified function may include one of a call function, a recording function, or a video shooting function.

According to certain embodiments, the processor may be configured to perform pre-processing on the first audio signal and to perform linear prediction analysis on the pre-processed signal to detect the spectral envelope signal.

According to certain embodiments, the processor may be configured to synthesize (or compose, or mix) the high-band extended signal and a spectral envelope signal corresponding to the first audio signal, based on a linear prediction voice synthesis scheme.

According to certain embodiments described above, an electronic device (e.g., the first electronic device 100 and the second electronic device 200 of FIG. 2) according to an embodiment may include a first microphone 170, a communication circuit 110 and a processor 150 operatively connected to the first microphone and the communication circuit. The processor may be configured to generate a first audio signal through the first microphone, to identify a noise level of the first audio signal obtained by the first microphone, to make a request for collection of a second audio signal based on a second microphone of an external electronic device through the communication circuit when the noise level is not less than a specified value, to extract a feature point from the second audio signal when collecting the second audio signal, to extend a high-band of the second audio signal based on the feature point and a spectral envelope signal extracted from the first audio signal, and to synthesize (or compose, or mix) the high-band extension signal and the first audio signal.

According to certain embodiments, the processor may be configured to omit an operation of signal synthesis and to support execution of the specified function based on the first audio signal, when the noise level is less than a specified magnitude.

According to certain embodiments, the processor may be configured to establish a short range communication channel with the external electronic device based on the communication circuit and to make a request for the collection of an audio signal having the higher distribution of low-band signals than the first audio signal among the external electronic device.

According to certain embodiments, when one execution of a call function execution request, a recording function execution request, or a video shooting function execution is requested, the processor may be configured to activate the first microphone, to identify the noise level, and to perform the signal synthesis depending on the noise level.

According to certain embodiments described above, an electronic device (e.g., the first electronic device 100) according to an embodiment may include a first microphone 170, a communication circuit 170 and a processor 150 operatively connected to the first microphone and the communication circuit. The processor may be configured to activate the first microphone automatically when one execution of a call function execution request, a recording function execution request, or a video shooting function execution is requested, to generate a first audio signal through the first microphone, to identify a noise level of the first audio signal obtained by the first microphone, to make a request for collection of a second audio signal based on a second microphone of an external electronic device through the communication circuit when the noise level is not less than a specified value, to extract a feature point from the second audio signal when collecting the second audio signal, to extend a high-band of the second audio signal based on the feature point and a spectral envelope signal extracted from the first audio signal, and to perform signal synthesize based on the high-band extension signal and the first audio signal. Alternatively, the processor 150 may be configured to estimate a spectral envelope signal corresponding to a first audio signal and to synthesize (or compose, or mix) the spectral envelope signal and the high-band extension signal.

Figure 12:
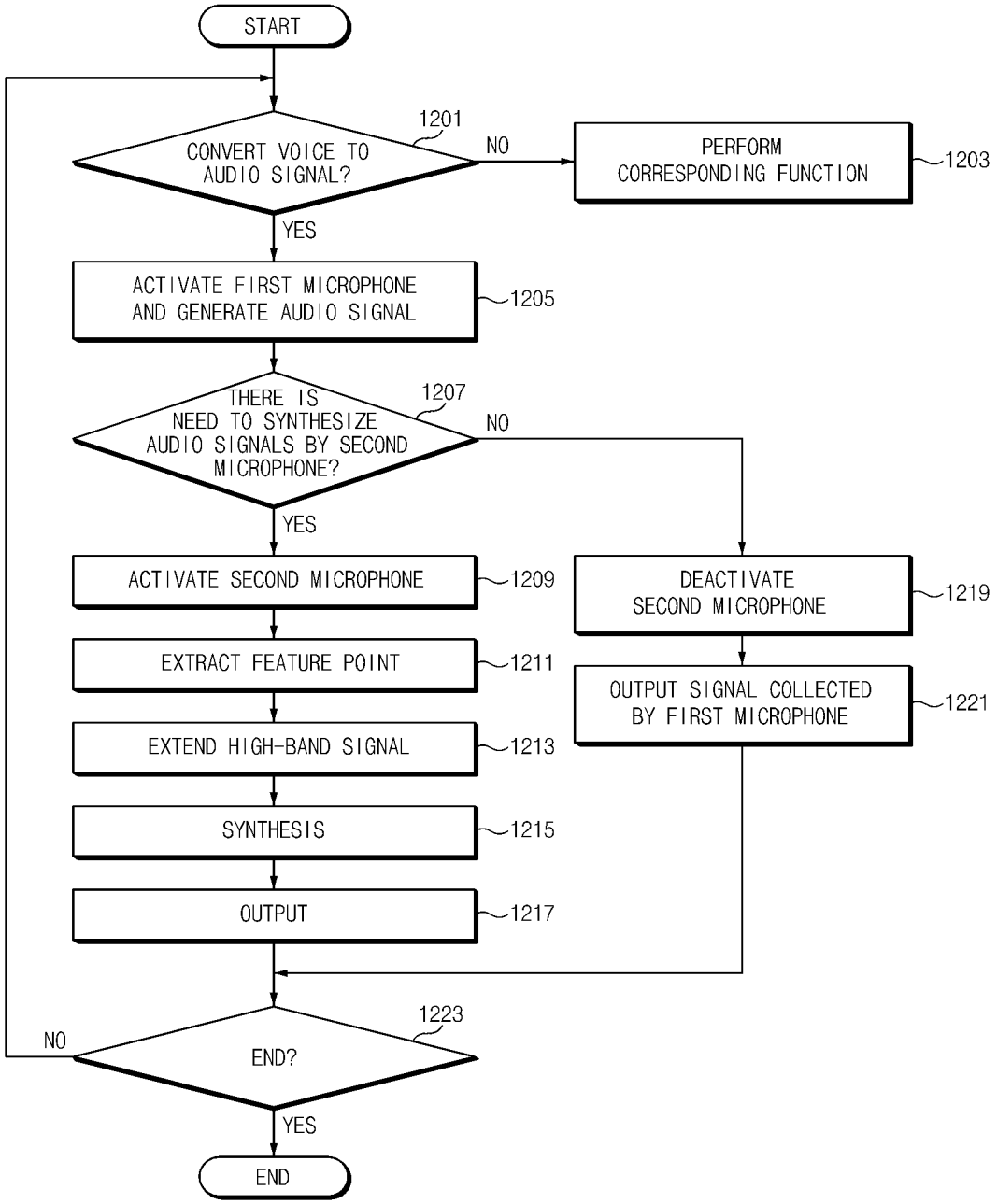
FIG. 12 is a view illustrating an example of an audio signal processing method according to an embodiment.

FIG. 12 is a view illustrating an example of an audio signal processing method according to an embodiment.

Referring to FIG. 12, with regard to an audio signal processing method according to an embodiment, when an event occurs, in operation 1201, the processor 150 of the first electronic device 100 may determine whether the event is associated with the request to convert voice to an audio signal. Alternatively, the processor 150 may determine whether an event (e.g., the reception of a user input, a call, or the like) associated with the request for executing a call function, a recording function, or a video shooting function that requires the collection an audio signal occurs. When the generated event is not associated with the request for the collection of audio signals, in operation 1203, the processor 150 may perform a function depending on the event occurrence. For example, the processor 150 may execute at least one content stored in the memory 140 depending on the event occurrence and may process at least one output of an audio and a video according to the execution of the content. Alternatively, the processor 150 may establish a communication channel with another electronic device in response to a user input and may receive and output the sound source provided by another electronic device.

When converting voice to audio signals is requested, in operation 1205, the processor 150 may perform the activation of the first microphone 170 and signal collection. For example, the first microphone 170 may be a microphone capable of collecting a wide-band (wider band) signal, compared to the second microphone 180. Alternatively, when the first electronic device 100 is an earphone, the first microphone 170 may include an external microphone in which a sound hole is positioned toward the outside of an ear upon wearing the earphone. The processor 150 may store the first audio signal generated by the first microphone 170, in the memory 140.

In operation 1207, the processor 150 may determine whether there is a need to synthesize the signals generated by the second microphone 180. In this regard, the processor 150 may identify the noise level (or SNR) of the first audio signal generated by the first microphone 170. When the noise included in the first audio signal generated by the first microphone 170 is not less than a specified magnitude (or when the SNR is less than a specified value), in operation 1209, the processor 150 may activate the second microphone 180. The second microphone 180 may include a microphone different in characteristics from the first microphone 170 or a microphone different in the placement location in an electronic device. According to an embodiment, the second microphone 180 may include an in-ear microphone. Alternatively, the second microphone 180 may be a microphone provided to generate a low-band signal relatively well, compared to the first microphone 170.

In operation 1211, the processor 150 may extract the feature point from the second audio signal generated by the second microphone 180. In a process of extracting a feature point, the processor 150 may calculate the feature point (e.g., $F_0$ (fundamental frequency), excitation, phase, or energy), which is advantageous to an environment in the second audio signal. Furthermore, the processor 150 may calculate the feature point (spectral envelope, excitation, phase, energy, or freq. response) having the entire bands from the selectively pre-processed first audio signal.

In operation 1213, the processor 150 may perform the extension of a high-band signal based on the extracted feature points and the spectral envelope signal extracted from the first audio signal. For example, the processor 150 may extend a band limited signal (a narrow-band signal) to a high-band, using the obtained feature point. In this operation, the processor 150 may use excitation extension or a frequency response. For example, the processor 150 may perform a process of copying the feature points of low-band signals and then pasting the feature points in a specified high-band to perform the extension of a high-band signal.

In operation 1215, the processor 150 may synthesize a high-band extended signal and the first audio signal (or a spectral envelope signal corresponding to the first audio signal) generated by the first microphone 170. For example, the processor 150 may perform the synthesis of the high-band extended signal and the first audio signal, depending on a method of synthesizing a linear prediction voice.

In operation 1217, the processor 150 may output the synthesized signal. For example, the processor 150 may transmit the synthesized signal to another electronic device establishing a short range communication channel depending on the running function or may transmit the synthesized signal to an external electronic device based on a base station. Alternatively, the processor 150 may store the synthesized signal in the memory 140 depending on a type of the running function or may store the synthesized signal in synchronization with the captured image.

When there is no need to synthesize the signals generated by the second microphone 180 (Condition 1207 is NO), in operation 1219, the processor 150 may deactivate the second microphone 180. For example, when the noise included in the first audio signal obtained by the first microphone 170 is less than a specified value, the signal synthesis function may be omitted. In this case, the processor 150 may deactivate the second microphone 180 or may maintain the deactivation state. When deactivating the second microphone 180, in operation 1221, the processor 150 may output the signal generated by the first microphone 170. For example, the processor 150 may store the first audio signal generated by the first microphone 170 in the memory 140 or may transmit the first audio signal to another electronic device.

In operation 1223, the processor 150 may determine whether an event associated with the termination of the function required to generate an audio signal occurs. For example, the processor 150 may identify the occurrence of an event for making a request for the termination of the function required to generate an audio signal. When the event for making a request for the termination of the function required to generate an audio signal occurs, the processor 150 may terminate an audio signal collecting function and may deactivate the first microphone 170 or the second microphone 180, which is active. When there is no occurrence of the termination event, the processor 150 may perform the following operation again by proceeding to the operation before operation 1201, operation 1205, operation 1209, or operation 1219 depending on the previously performed function state.

In the meantime, the operation is described based on the processor 150 of the first electronic device 100 with respect to the audio signal processing method described above with reference to FIG. 12. However, the disclosure is not limited thereto. For example, each of the operations in the audio signal processing method described with reference to FIG. 12 may be performed based on the processor 250, the plurality of microphones MICs, the terminal memory 240, or the like of the second electronic device 200.

Figure 13:
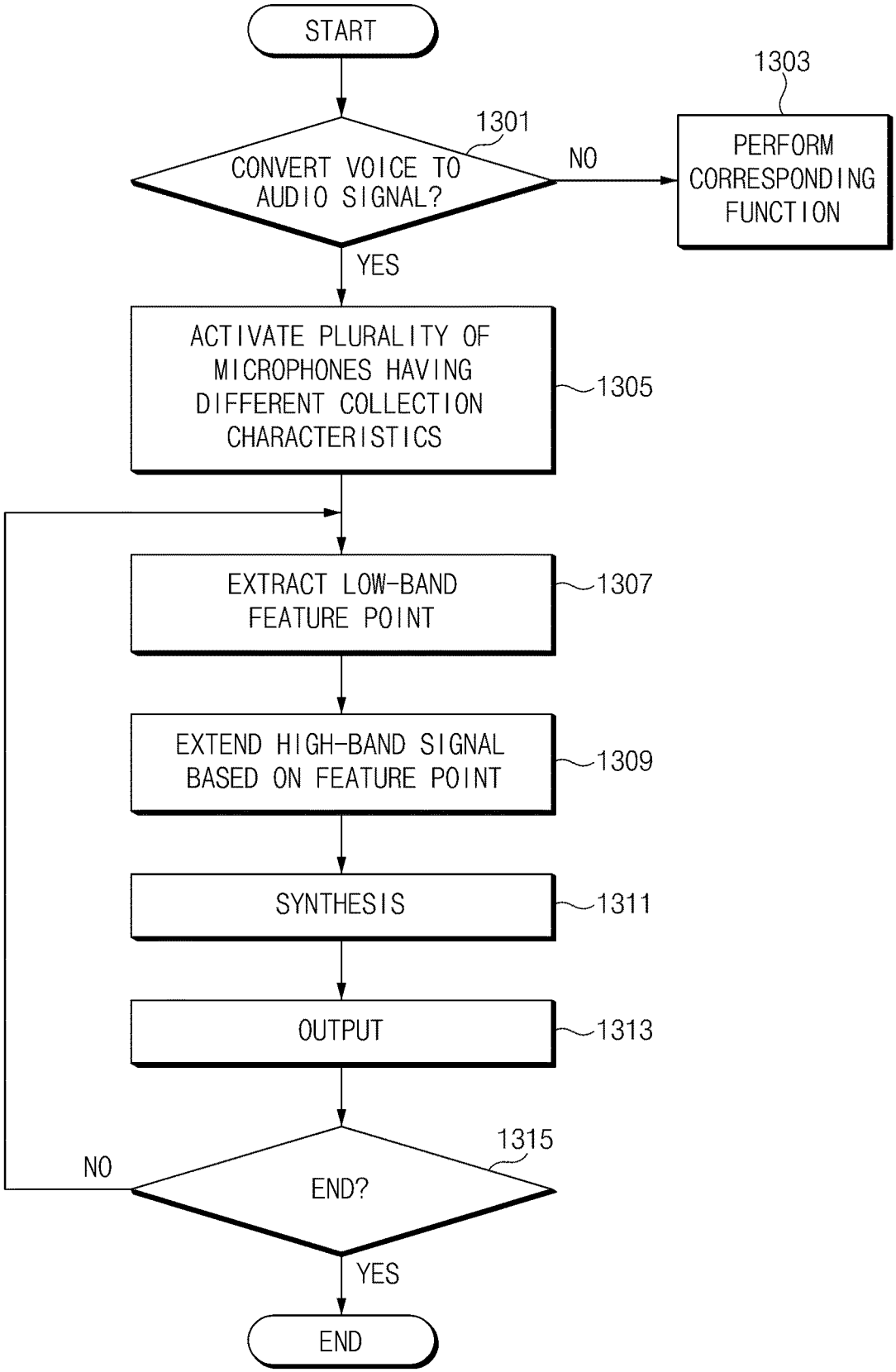
FIG. 13 is a view illustrating an example of an audio signal processing method according to another embodiment.

FIG. 13 is a view illustrating an example of an audio signal processing method according to another embodiment.

Referring to FIG. 13, with regard to the audio signal processing method according to an embodiment, in operation 1301, the processor 150 of the first electronic device 100 may determine whether the corresponding event is to convert voice to an audio signals, when an event associated with the execution of a specific function occurs. When the event not associated with the collection of audio signals occurs, in operation 1303, the processor 150 may support the execution of a function according to a type of event. For example, when an event associated with a sound source playback function occurs, the processor 150 may play a sound source stored in a memory and may output the played sound source.

When the event associated with converting voice to audio signals occurs, in operation 1305, the processor 150 may activate a plurality of microphones having different collection characteristics. For example, the processor 150 may activate the first microphone 170, which obtains a frequency band signal in a range wider than the second microphone 180, and the second microphone 180 provided to generate signals in a range narrower than the first microphone 170 or relatively low-band signals. Alternatively, the processor 150 may activate an in-ear microphone and an external microphone, which are disposed on one side of the housing of a wireless headset or one side of the housing of a wireless earphone.

In operation 1307, the processor 150 may extract a low-band feature point from the audio signal, which is generated by the second microphone 180, from among the obtained signals. In this regard, the processor 150 may perform linear prediction analysis on the generated audio signal.

In operation 1309, the processor 150 may perform the extension of a high-band signal based on the extracted feature point. For example, the processor 150 may detect a spectral envelope for the audio signal generated by the first microphone 170 and may extend the high-band signal based on the detected spectral envelope signal and the extracted feature point.

In operation 1311, the processor 150 may synthesize (or compose, or mix) a high-band extended signal and the audio signal generated by the first microphone 170. In the synthesis operation, the processor 150 may perform linear prediction synthesis on the high-band extended signal and the first audio signal.

In operation 1313, the processor 150 may output the synthesized signal. For example, the processor 150 may output the synthesized signal through a speaker or may transmit the synthesized signal to another electronic device. Alternatively, the processor 150 may store the synthesized signal in the memory 140.

In operation 1315, the processor 150 may determine whether an event of the function termination associated with the collection of audio signals occurs. When the event of the function termination is not present, the processor 150 may proceed to operation 1307 to perform the following operations again.

In the meantime, the operation is described based on the processor 150 of the first electronic device 100 with respect to the audio signal processing method described above with reference to FIG. 13. However, the disclosure is not limited thereto. For example, each of the operations in the audio signal processing method described with reference to FIG. 12 may be performed based on the processor 250, the plurality of microphones MICs, the terminal memory 240, or the like of the second electronic device 200.

Figure 14:
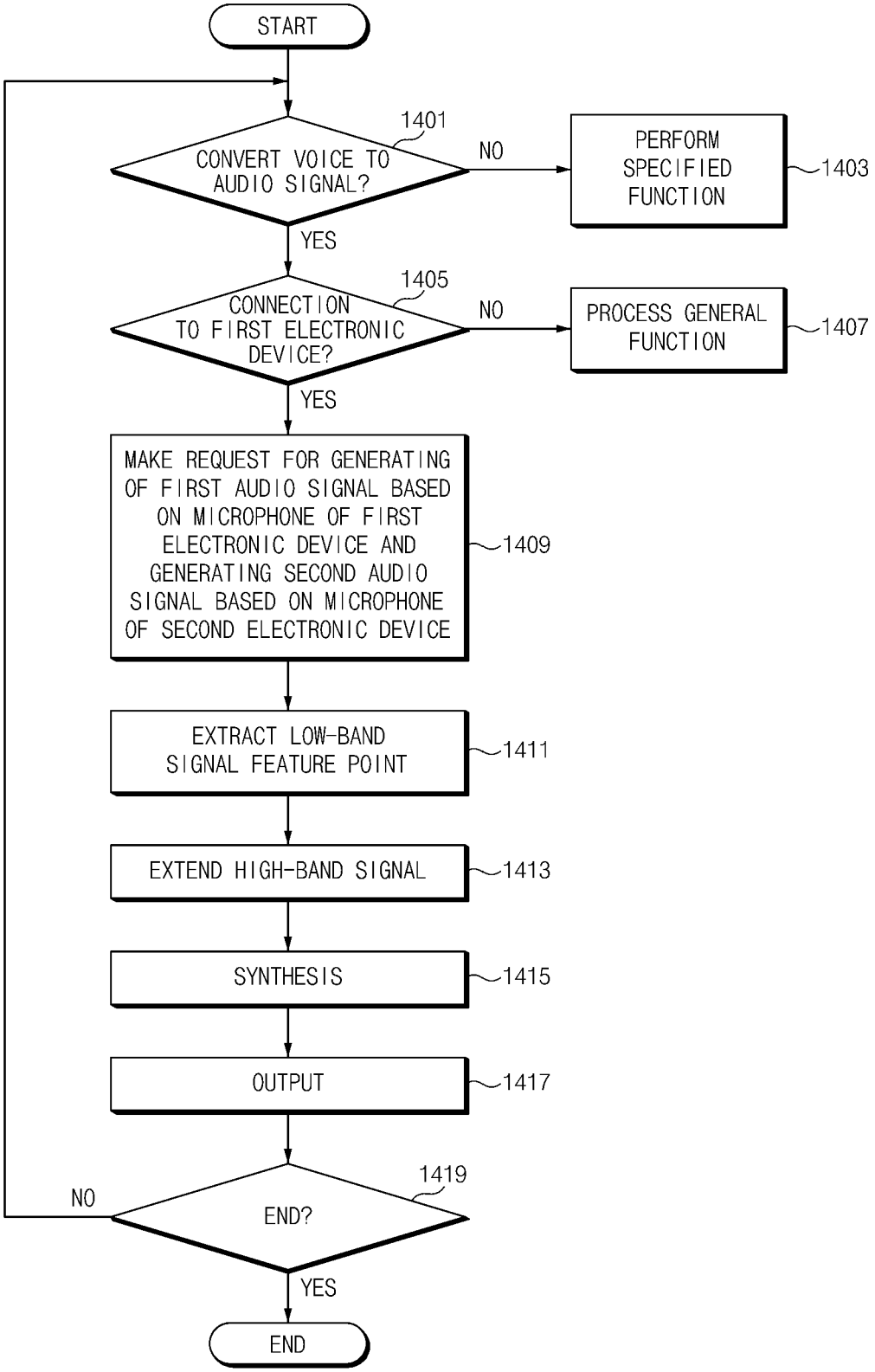
FIG. 14 is a view illustrating another example of an audio signal processing method according to another embodiment.

FIG. 14 is a view illustrating another example of an audio signal processing method according to another embodiment.

Referring to FIG. 14, with regard to the audio signal processing method according to an embodiment, in operation 1401, the processor 250 of the second electronic device 200 may determine whether the corresponding event is convert voice to an audio signal, when an event associated with the execution of a specific function occurs. When the event not associated with the collection of audio signals occurs, in operation 1403, the processor 250 may support the execution of a function according to a type of event.

In the case of an event associated with the converting voice to audio signals, in operation 1405, the processor 250 may determine whether the processor 250 is connected to an external electronic device. When the processor 250 is not connected to an external electronic device, in operation 1407, the processor 250 may perform general function processing. For example, the processor 250 may activate at least one specific microphone among a plurality of microphones MICs included in the electronic device 200; the processor 250 may generate an audio signal based on the specific microphone and then may store the audio signal in the terminal memory 240, may output the audio signal to a speaker, or may transmit the audio signal to another electronic device.

When the first electronic device 100 is connected, in operation 1409, the processor 250 may generate a second audio signal based on the microphone (e.g., at least one specific microphone among the plurality of microphones MICs) of the second electronic device 200, while requesting the microphone (e.g., the first microphone 170) of the first electronic device 100 to generate a first audio signal. The processor 250 may receive the first audio signal from the first electronic device 100 depending on a request for collecting the first audio signal. According to an embodiment, the second electronic device 200 may be a terminal device (e.g., a smartphone), and the first electronic device 100 may be an earphone or a headset device. The first audio signal may include a frequency signal of a relatively wide-band, compared to the second audio signal. The second audio signal may include a relatively narrow-band frequency signal, as compared to the first audio signal, or a signal, in which the distribution of a low-band frequency signal is high. According to certain embodiments, the second electronic device may be a headset or an earphone device, and the first electronic device may be a terminal device. In this case, the microphone disposed in the second electronic device may be a microphone (e.g., a microphone collecting signals inside an ear) designed to generate relatively low-band signals well, compared to the microphone disposed in the first electronic device.

In operation 1411, the processor 250 may extract a low-band signal feature point for the second audio signal generated by the second electronic device 200. Alternatively, when the first electronic device 100 provides an audio signal based on an in-ear microphone, the processor 250 may extract the low-band signal feature point for the audio signal provided by the first electronic device 100. In operation 1413, the processor 250 may extend a high-band signal, using the feature point of the obtained low-band signal (e.g., extend a high-band signal using the feature point and the spectral envelope signal detected from the first audio signal); in operation 1415, the processor 250 may synthesize the high-band extended signal and the first audio signal (or a relatively wide-band frequency signal) and then may output the synthesized signal in the operation 1417.

According to certain embodiments, in operation 1405, the processor 250 may determine whether there is a need for the connection to the first electronic device 100. For example, the processor 250 may generate an audio signal based on the microphone included in the second electronic device 200 and may determine whether the noise level included in the generated audio signal is less than a specified level. When the noise level is not less than the specified level, the processor 250 may determine whether the communication connection with the first electronic device 100 is made. When there is no connection to the first electronic device 100, the processor 250 may scan the first electronic device 100 and may perform communication connection with the first electronic device 100.

According to certain embodiments, when the processor 250 is a terminal device including a display and is not connected to the first electronic device 100, the processor 250 may output, to the display 260, information indicating that there is a need for the connection to the first electronic device 100, with respect to the collection of good audio signals. Additionally, the processor 250 may output link information or a virtual object, which is capable of performing pairing with an external electronic device, to the display 260.

In the meantime, the operation is described based on the processor 250 of the second electronic device 200 with respect to the audio signal processing method described above with reference to FIG. 14. However, the disclosure is not limited thereto. For example, each of the operations in the audio signal processing method described with reference to FIG. 14 may be performed based on the processor 150, the plurality of microphones 170 and 180, the terminal memory 140, or the like of the first electronic device 100.

As described above, the audio signal processing method according to an embodiment may identify the exact characteristics of the band requiring the extension (e.g., identifying signals requiring band extension based on the spectral envelope signal) when the band extension technology is applied and may generate a natural synthesized signal through signal extension and synthesis of the corresponding band. Furthermore, the audio signal processing method according to an embodiment may generate a synthesized signal having a high quality sound based on a noise-free excitation signal and a spectral envelope signal when the high-band signal is extended, by performing noise pre-processing on a narrow-band signal and noise pre-processing of the signal received through an external microphone.

Such the audio signal processing method may apply a natural band extension based on the audio signals generated by microphones of different characteristics and may support stable voice signal collection even in high noise situations. For example, the audio signal processing method according to an embodiment may predict the excitation signal, using high-accuracy voice activity detector (VAD) information, which is received through a microphone (e.g., an in-ear microphone or a bone conduction microphone) robust to the noise and has the high accuracy, may perform sophisticated expansion of the predicted band limited excitation signal, using the fundamental frequency calculated in the noise-free situation, may determine the situation of other microphone inputs (e.g., an external microphone) with information of a wide band of to predict the spectral envelope after noise pre-processing, and may output the high-quality results through the synthesis of a band extension signal and the spectral envelope signal.

According to certain embodiments described above, an electronic device according to an embodiment may include a first microphone and a second microphone and a processor operatively connected to the first microphone and the second microphone. The processor may be configured to generate a first audio signal through the first microphone and generate a second audio signal through the second microphone, to detect a spectral envelope signal from the first audio signal and extract a feature point from the second audio signal, to extend a high-band of the second audio signal based on the spectral envelope signal and the feature point, and to synthesize the high-band extension signal and the first audio signal.

The first microphone may include an external microphone disposed on one side of an earphone or a headset and disposed on one side of a housing, which is mounted on an ear, in a portion of the housing of the earphone or the headset.

The second microphone may include at least one of an in-ear microphone or a bone conduction microphone.

The first audio signal may include a signal having the higher distribution of relatively wide band (wider band) signals than the second audio signal.

The second audio signal may include a signal having the higher distribution of low-band signals than the first audio signal.

The processor may be configured to identify a noise level included in the first audio signal, to perform pre-processing on the first audio signal when the noise level is not less than a specified value, and to perform linear prediction analysis on the pre-processed signal to detect the spectral envelope signal.

The processor may be configured to omit pre-processing on the first audio signal when the noise level included in the first audio signal is less than the specified value, and to perform the linear prediction analysis on an audio signal, on which the pre-processing is omitted, to detect the spectral envelope signal.

The processor may be configured to store the synthesized signal in a memory, to output the synthesized signal through a speaker, or to transmit the synthesized signal to an external electronic device connected based on a communication circuit.

The processor may be configured to automatically control activation of the first microphone and the second microphone when one of a call function execution request, a recording function execution request, or a video shooting function execution is requested, and to perform signal synthesis.

According to certain embodiments, an audio signal processing method of an electronic device including a plurality of microphones according to an embodiment may include collecting a first audio signal through a first microphone among the plurality of microphones and collecting a second audio signal through a second microphone among the plurality of microphones, detecting a spectral envelope signal from the first audio signal and extracting a feature point from the second audio signal, extending a high-band of the second audio signal based on the spectral envelope signal and the feature point, and performing signal synthesis based on the high-band extension signal and the first audio signal.

The method module may further include identifying a noise level included in the first audio signal. The performing of the synthesis may include performing pre-processing on the first audio signal when the noise level is not less than a specified value, performing linear prediction analysis on the pre-processed signal to detect the spectral envelope signal, and synthesizing the detected spectral envelope signal and the high-band extension signal.

The detecting of the spectral envelope signal may include omitting pre-processing on the first audio signal when the noise level included in the first audio signal is less than the specified value, and performing the linear prediction analysis on an audio signal, on which the pre-processing is omitted, to detect the spectral envelope signal.

The method may further include one of storing the synthesized signal in a memory, outputting the synthesized signal through a speaker, or transmitting the synthesized signal to an external electronic device connected based on a communication circuit.

The method may further include receiving one execution request of a call function execution request, a recording function execution request, or a video shooting function execution request and automatically activating the first microphone and the second microphone.

According to certain embodiments, an electronic device according to an embodiment may include a first microphone, a communication circuit and a processor operatively connected to the first microphone and the communication circuit. The processor may be configured to generate a first audio signal through the first microphone, to identify a noise level of the first audio signal obtained by the first microphone, to make a request for collection of a second audio signal based on a second microphone of an external electronic device through the communication circuit when the noise level is not less than a specified value, to extract a feature point from the second audio signal when collecting the second audio signal, to extend a high-band of the second audio signal based on the feature point and a spectral envelope signal extracted from the first audio signal, and to synthesize the high-band extension signal and the first audio signal.

The processor may be configured to omit an operation of synthesizing of the high-band extension signal and the first audio signal when the noise level is less than a specified magnitude and to support execution of a specified function based on the first audio signal.

Figure 15:
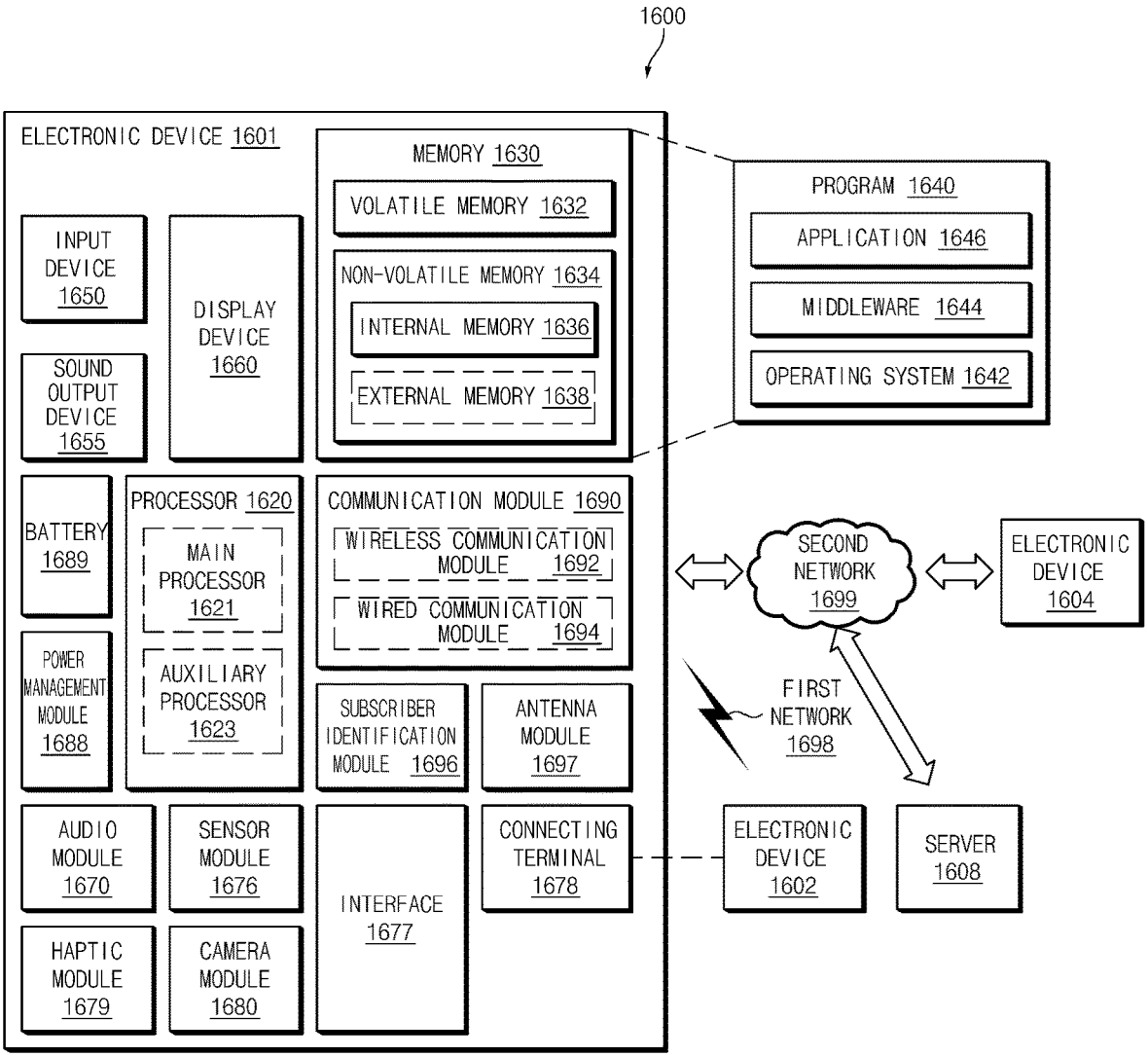
FIG. 15 is a block diagram illustrating an electronic device 1501 in a network environment 1500 according to certain embodiments.

FIG. 15 is a block diagram illustrating an electronic device 1501 in a network environment 1500 according to certain embodiments. Referring to FIG. 15, the electronic device 1501 in the network environment 1500 may communicate with an electronic device 1502 via a first network 1598 (e.g., a short-range wireless communication network), or an electronic device 1504 or a server 1508 via a second network 1599 (e.g., a long-range wireless communication network). According to an embodiment, the electronic device 1501 may communicate with the electronic device 1504 via the server 1508. According to an embodiment, the electronic device 1501 may include a processor 1520, memory 1530, an input device 1550, a sound output device 1555, a display device 1560, an audio module 1570, a sensor module 1576, an interface 1577, a haptic module 1579, a camera module 1580, a power management module 1588, a battery 1589, a communication module 1590, a subscriber identification module(SIM) 1596, or an antenna module 1597. In some embodiments, at least one (e.g., the display device 1560 or the camera module 1580) of the components may be omitted from the electronic device 1501, or one or more other components may be added in the electronic device 1501. In some embodiments, some of the components may be implemented as single integrated circuitry. For example, the sensor module 1576 (e.g., a fingerprint sensor, an iris sensor, or an illuminance sensor) may be implemented as embedded in the display device 1560 (e.g., a display).

The processor 1520 may execute, for example, software (e.g., a program 1540) to control at least one other component (e.g., a hardware or software component) of the electronic device 1501 coupled with the processor 1520, and may perform various data processing or computation. According to one embodiment, as at least part of the data processing or computation, the processor 1520 may load a command or data received from another component (e.g., the sensor module 1576 or the communication module 1590) in volatile memory 1532, process the command or the data stored in the volatile memory 1532, and store resulting data in non-volatile memory 1534. According to an embodiment, the processor 1520 may include a main processor 1521 (e.g., a central processing unit (CPU) or an application processor (AP)), and an auxiliary processor 1523 (e.g., a graphics processing unit (GPU), an image signal processor (ISP), a sensor hub processor, or a communication processor (CP)) that is operable independently from, or in conjunction with, the main processor 1521. Additionally or alternatively, the auxiliary processor 1523 may be adapted to consume less power than the main processor 1521, or to be specific to a specified function. The auxiliary processor 1523 may be implemented as separate from, or as part of the main processor 1521.

The auxiliary processor 1523 may control at least some of functions or states related to at least one component (e.g., the display device 1560, the sensor module 1576, or the communication module 1590) among the components of the electronic device 1501, instead of the main processor 1521 while the main processor 1521 is in an inactive (e.g., sleep) state, or together with the main processor 1521 while the main processor 1521 is in an active state (e.g., executing an application). According to an embodiment, the auxiliary processor 1523 (e.g., an image signal processor or a communication processor) may be implemented as part of another component (e.g., the camera module 1580 or the communication module 1590) functionally related to the auxiliary processor 1523.

The memory 1530 may store various data used by at least one component (e.g., the processor 1520 or the sensor module 1576) of the electronic device 1501. The various data may include, for example, software (e.g., the program 1540) and input data or output data for a command related thererto. The memory 1530 may include the volatile memory 1532 or the non-volatile memory 1534.

The program 1540 may be stored in the memory 1530 as software, and may include, for example, an operating system (OS) 1542, middleware 1544, or an application 1546.

The input device 1550 may receive a command or data to be used by other component (e.g., the processor 1520) of the electronic device 1501, from the outside (e.g., a user) of the electronic device 1501. The input device 1550 may include, for example, a microphone, a mouse, a keyboard, or a digital pen (e.g., a stylus pen).

The sound output device 1555 may output sound signals to the outside of the electronic device 1501. The sound output device 1555 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 1560 may visually provide information to the outside (e.g., a user) of the electronic device 1501. The display device 1560 may include, for example, a display, a hologram device, or a projector and control circuitry to control a corresponding one of the display, hologram device, and projector. According to an embodiment, the display device 1560 may include touch circuitry adapted to detect a touch, or sensor circuitry (e.g., a pressure sensor) adapted to measure the intensity of force incurred by the touch.

The audio module 1570 may convert a sound into an electrical signal and vice versa. According to an embodiment, the audio module 1570 may obtain the sound via the input device 1550, or output the sound via the sound output device 1555 or a headphone of an external electronic device (e.g., an electronic device 1502) directly (e.g., wiredly) or wirelessly coupled with the electronic device 1501.

The sensor module 1576 may detect an operational state (e.g., power or temperature) of the electronic device 1501 or an environmental state (e.g., a state of a user) external to the electronic device 1501, and then generate an electrical signal or data value corresponding to the detected state. According to an embodiment, the sensor module 1576 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1577 may support one or more specified protocols to be used for the electronic device 1501 to be coupled with the external electronic device (e.g., the electronic device 1502) directly (e.g., wiredly) or wirelessly. According to an embodiment, the interface 1577 may include, for example, a high definition multimedia interface (HDMI), a universal serial bus (USB) interface, a secure digital (SD) card interface, or an audio interface.

A connecting terminal 1578 may include a connector via which the electronic device 1501 may be physically connected with the external electronic device (e.g., the electronic device 1502). According to an embodiment, the connecting terminal 1578 may include, for example, a HDMI connector, a USB connector, a SD card connector, or an audio connector (e.g., a headphone connector).

The haptic module 1579 may convert an electrical signal into a mechanical stimulus (e.g., a vibration or a movement) or electrical stimulus which may be recognized by a user via his tactile sensation or kinesthetic sensation. According to an embodiment, the haptic module 1579 may include, for example, a motor, a piezoelectric element, or an electric stimulator.

The camera module 1580 may capture a still image or moving images. According to an embodiment, the camera module 1580 may include one or more lenses, image sensors, image signal processors, or flashes.

The power management module 1588 may manage power supplied to the electronic device 1501. According to one embodiment, the power management module 1588 may be implemented as at least part of, for example, a power management integrated circuit (PMIC).

The battery 1589 may supply power to at least one component of the electronic device 1501. According to an embodiment, the battery 1589 may include, for example, a primary cell which is not rechargeable, a secondary cell which is rechargeable, or a fuel cell.

The communication module 1590 may support establishing a direct (e.g., wired) communication channel or a wireless communication channel between the electronic device 1501 and the external electronic device (e.g., the electronic device 1502, the electronic device 1504, or the server 1508) and performing communication via the established communication channel. The communication module 1590 may include one or more communication processors that are operable independently from the processor 1520 (e.g., the application processor (AP)) and supports a direct (e.g., wired) communication or a wireless communication. According to an embodiment, the communication module 1590 may include a wireless communication module 1592 (e.g., a cellular communication module, a short-range wireless communication module, or a global navigation satellite system (GNSS) communication module) or a wired communication module 1594 (e.g., a local area network (LAN) communication module or a power line communication (PLC) module). A corresponding one of these communication modules may communicate with the external electronic device via the first network 1598 (e.g., a short-range communication network, such as Bluetooth™, wireless-fidelity (Wi-Fi) direct, or infrared data association (IrDA)) or the second network 1599 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1592 may identify and authenticate the electronic device 1501 in a communication network, such as the first network 1598 or the second network 1599, using subscriber information (e.g., international mobile subscriber identity (IMSI)) stored in the subscriber identification module 1596.

The antenna module 1597 may transmit or receive a signal or power to or from the outside (e.g., the external electronic device) of the electronic device 1501. According to an embodiment, the antenna module 1597 may include an antenna including a radiating element composed of a conductive material or a conductive pattern formed in or on a substrate (e.g., PCB). According to an embodiment, the antenna module 1597 may include a plurality of antennas. In such a case, at least one antenna appropriate for a communication scheme used in the communication network, such as the first network 1598 or the second network 1599, may be selected, for example, by the communication module 1590 (e.g., the wireless communication module 1592) from the plurality of antennas. The signal or the power may then be transmitted or received between the communication module 1590 and the external electronic device via the selected at least one antenna. According to an embodiment, another component (e.g., a radio frequency integrated circuit (RFIC)) other than the radiating element may be additionally formed as part of the antenna module 1597.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1501 and the external electronic device 1504 via the server 1508 coupled with the second network 1599. Each of the electronic devices 1502 and 1504 may be a device of a same type as, or a different type, from the electronic device 1501. According to an embodiment, all or some of operations to be executed at the electronic device 1501 may be executed at one or more of the external electronic devices 1502, 1504, or 1508. For example, if the electronic device 1501 should perform a function or a service automatically, or in response to a request from a user or another device, the electronic device 1501, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1501. The electronic device 1501 may provide the outcome, with or without further processing of the outcome, as at least part of a reply to the request. To that end, a cloud computing, distributed computing, or client-server computing technology may be used, for example.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 1540) including one or more instructions that are stored in a storage medium (e.g., internal memory 1536 or external memory 1538) that is readable by a machine (e.g., the electronic device 1501). For example, a processor(e.g., the processor 1520) of the machine (e.g., the electronic device 1501) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory storage medium" means a tangible device, and does not include a signal (e.g., an electromagnetic wave), but this term does not differentiate between where data is semi-permanently stored in the storage medium and where the data is temporarily stored in the storage medium. For example, "the non-transitory storage medium" may include a buffer where data is temporally stored.

According to an embodiment, a method according to certain embodiments of the disclosure may be included and provided in a computer program product. The computer program product may be traded as a product between a seller and a buyer. The computer program product (e.g., downloadable app)) may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

According to embodiments disclosed in the specification, an embodiment of the disclosure may synthesize and provide a good voice signal by using a plurality of microphones depending on a surrounding environment.

Embodiments of the disclosure allow the voice quality or the like of a voice recognition function, a call function, or a recording function to be improved.

Besides, a variety of effects directly or indirectly understood through the disclosure may be provided.

While the disclosure has been shown and described with reference to certain embodiments thereof, it will be understood by those skilled in the art that various changes in form and details may be made therein without departing from the spirit and scope of the disclosure as defined by the appended claims and their equivalents.

What is claimed is:

1. An electronic device including a plurality of microphones comprising:

at least one processor configured to:

receive a first audio signal from a first microphone among a plurality of microphones and a second audio signal from a second microphone among a plurality of microphones;

detect a wide-band spectral envelope signal from the first audio signal and extract a narrow-band excitation signal from the second audio signal;

extend a high-band of the second audio signal based on the wide-band spectral envelope signal from the first audio signal and the narrow-band excitation signal from the second audio signal to generate a high-band extension signal; and mix the high-band extension signal and the first audio signal, thereby resulting in a synthesized signal.

2. The electronic device of claim 1, wherein the first microphone and the second microphone are operatively connected to the at least one processor, and wherein the first microphone includes an external microphone disposed on one side of an earphone or a headset and the second microphone disposed on one side of a housing configured to be mounted in an ear.

3. The electronic device of claim 2, wherein the second microphone includes at least one of an in-ear microphone or a bone conduction microphone.

4. The electronic device of claim 1, wherein the first audio signal includes a signal in a band wider than the second audio signal.

5. The electronic device of claim 1, wherein the second audio signal includes greater energy in a low-band than the first audio signal.

6. The electronic device of claim 1, wherein the at least one processor is configured to:

identify a noise level included in the first audio signal;

when the noise level exceeds a specified value, perform pre-processing on the first audio signal; and perform linear prediction analysis on the pre-processed signal and detect the wide-band spectral envelope signal.

7. The electronic device of claim 6, wherein the at least one processor is configured to:

when the noise level included in the first audio signal is less than the specified value, perform the linear prediction analysis on the first audio signal and detect the wide-band spectral envelope signal.

8. The electronic device of claim 1, wherein the at least one processor is configured to:

store the synthesized signal in a memory;

output the synthesized signal through a speaker; or transmit the synthesized signal to an external electronic device connected with a communication circuit.

9. The electronic device of claim 2, wherein the at least one processor is configured to:

when one of a call function execution request, a recording function execution request, or a video shooting function execution request is requested, automatically control activation of the first microphone and the second microphone; and perform mixing of the high-band extension signal and the first audio signal.

10. An audio signal processing method of an electronic device including a plurality of microphones, the method comprising:

receiving a first audio signal from a first microphone among a plurality of microphones and obtaining a second audio signal through a second microphone among the plurality of microphones;

detecting a wide-band spectral envelope signal from the first audio signal and extracting a narrow-band excitation signal from the second audio signal;

extending a high-band signal of the second audio signal based on the wide-band spectral envelope signal from the first audio signal and the narrow-band excitation signal from the second audio signal to generate a high-band extension signal; and mixing the high-band extension signal and the first audio signal.

11. The method of claim 10, wherein the first microphone includes an external microphone disposed on one side of an earphone or a headset and the second microphone is disposed on one side of a housing configured to be mounted in an ear.

12. The method of claim 10, wherein the second microphone includes at least one of an in-ear microphone or a bone conduction microphone.

13. The method of claim 10, wherein the first audio signal includes a signal in a band wider than the second audio signal.

14. The method of claim 10, wherein the second audio signal hear greater energy in a low-band than the first audio signal.

15. The method of claim 10, further comprising:

identifying a noise level included in the first audio signal, wherein mixing includes:

when the noise level exceeds a specified value, preprocessing the first audio signal;

performing linear prediction analysis on the pre-processed signal and detecting the wide-band spectral envelope signal; and mixing the detected wide-band spectral envelope signal and the high-band extension signal.

16. The method of claim 15, wherein the detecting of the wide-band spectral envelope signal includes:

when the noise level included in the first audio signal is less than the specified value, performing the linear prediction analysis on the first audio signal and detecting the wide-band spectral envelope signal.

17. The method of claim 10, further comprising one of:

storing the mixed signal in a memory;

outputting the mixed signal through a speaker; or transmitting the mixed signal to an external electronic device connected based on a communication circuit.

18. The method of claim 10, further comprising:

receiving one of a call function execution request, a recording function execution request, or a video shooting function execution request; and automatically activating the first microphone and the second microphone.

19. An electronic device including a plurality of microphones comprising:

a first microphone, a communication circuit and at least one processor operatively connected to the first microphone and the communication circuit, wherein the at least one processor is configured to:

when activating the first microphone, obtain a first audio signal through the first microphone;

identify a noise level of the first audio signal obtained by the activated first microphone;

when the noise level exceeds a specified value, activating a second microphone configured to generate a second audio signal through the communication circuit;

when obtaining the second audio signal, extract a narrow-band excitation signal from the second audio signal;

extend a high-band portion of the second audio signal based on the narrow-band excitation signal from the second audio signal and a wide-band spectral envelope signal extracted from the first audio signal, thereby resulting in a high-band extension signal; and mixing the high-band extension signal and the first audio signal.

20. The electronic device of claim 19, wherein the at least one processor is configured to:

when the noise level of the first audio signal is less than the specified value, support deactivation of the second microphone and support execution of a specified function based on the first audio signal through the activated first microphone, and when the noise level of the first audio signal exceeds the specified value, support activation of the second microphone and support execution of a specified function based on the first audio signal through the activated first microphone and the second audio signal through the activated second microphone.

* * * * *